US008733213B2

(12) United States Patent
Taggart

(10) Patent No.: US 8,733,213 B2
(45) Date of Patent: May 27, 2014

(54) POWER TONG APPARATUS

(75) Inventor: Mark Charles Taggart, High River (CA)

(73) Assignee: Rangeland Drilling Automation Inc., Calgary (CA)

( * ) Notice: Subject to any disclaimer, the term of this patent is extended or adjusted under 35 U.S.C. 154(b) by 101 days.

(21) Appl. No.: 13/438,766

(22) Filed: Apr. 3, 2012

(65) Prior Publication Data

US 2013/0255446 A1 Oct. 3, 2013

(51) Int. Cl.
*E21B 19/16* (2006.01)
*E21B 19/18* (2006.01)

(52) U.S. Cl.
CPC ..... *E21B 19/16* (2013.01); *E21B 19/161* (2013.01)
USPC ..... 81/57.11; 81/57.35

(58) Field of Classification Search
USPC ..... 81/57.11, 57.15, 57.34, 57.35, 57.4; 166/75.51, 77.53, 85.1
See application file for complete search history.

(56) References Cited

U.S. PATENT DOCUMENTS

| | | | | |
|---|---|---|---|---|
| 3,505,913 | A * | 4/1970 | Dickmann et al. | 81/57.35 |
| 3,780,815 | A * | 12/1973 | Barron et al. | 173/195 |
| 6,318,214 | B1 * | 11/2001 | Buck | 81/57.35 |
| 7,313,986 | B2 * | 1/2008 | West et al. | 81/57.16 |
| 7,690,281 | B2 * | 4/2010 | Hobgood | 81/57.35 |
| 7,707,914 | B2 * | 5/2010 | Pietras et al. | 81/57.16 |
| 8,550,174 | B1 * | 10/2013 | Orgeron et al. | 166/380 |
| 2013/0192427 | A1 * | 8/2013 | Aarhus et al. | 81/57.11 |

* cited by examiner

*Primary Examiner* — David B Thomas
(74) *Attorney, Agent, or Firm* — Christensen O'Connor Johnson Kindness PLLC

(57) ABSTRACT

A power tong apparatus is provided. The power can include a vertical riser assembly for attaching to a drilling rig, and a swing arm assembly pivotally attached to the vertical riser assembly. The apparatus can include a power tong assembly pivotally attached to the swing arm assembly. The power tong assembly can include a back-up tong to grip a first pipe, and a power tong to grip and rotate a second pipe to make or break a joint between the pipes. The power tong can include a jaw assembly that, when rotated, grips the second pipe. The power tong can include a hydraulic motor to operate a drive chain or belt to rotate the jaw assembly.

29 Claims, 29 Drawing Sheets

POWER TONG APPARATUS

TECHNICAL FIELD

The present disclosure is related to the field of tools for use on a well, in particular, automated and hydraulic-powered power tongs for making and breaking joints between sections of pipe.

BACKGROUND

In drilling a well, a drill string is used. The drill string can comprise a drill bit attached to sections of drill pipe. As the well is drilled, additional sections of drill pipe are added to the drill string to extend its length until the well is drilled deep enough to reach a formation where substances, such as water, oil or gas, can be produced from the well. Sections of pipe are joined together using threaded connections on the pipe, often referred to as "pin" and "box", where the pin of one section of pipe is threaded into the box into an adjoining section of pipe. The drill string is rotated to turn the drill bit in order to drill the well. When the drill string is removed from the wellbore, the sections of pipe can be removed from the drill string one or more sections at a time.

To make or break the threaded connection between sections of pipe, a power tong device can be used to do so. Known designs use a motor with a transmission to operate the power tong mechanism to grip and turn one section of pipe relative to another section of pipe to thread them together or to separate them. When breaking a joint, the power tong uses a lower gear to increase the torque applied to the pipe to a level required to break the joint, then the power tong is shifted to a higher gear to increase the rotation speed of the pipe to unthread the connection. When a making a joint, the higher gear can be used to start the threaded connection, and then the lower gear is used to torque the connection together. This process of shifting gears to make or break joints is time consuming, and can make the time required to replace a worn out drill bit, thus requiring the complete removal of the entire drill string and then reinstalling the drill string, quite lengthy.

It is, therefore, desirable to provide a power tong overcomes the shortcomings of the prior art and decrease the time required to make and break joints between sections of pipe on a drilling rig.

SUMMARY

Broadly stated, in some embodiments, a power tong apparatus is provided for making and breaking connection joints between sections of pipe on a drilling rig, the apparatus comprising: a support assembly, further comprising a vertical riser assembly configured for attachment to the drilling rig, and a swing arm assembly operatively attached to the vertical riser assembly wherein the vertical riser and swing arm assemblies are configured such that the swing arm assembly can move up and down relative to the vertical riser assembly, the swing arm assembly further configured to pivot in a substantially horizontal plane relative to the vertical riser assembly; a power tong assembly operatively attached to the swing arm assembly, the power tong assembly further comprising: a back-up tong configured to grasp a first section of pipe, a power tong configured to grasp and rotate a second section of pipe relative to the first section of pipe to make or break a connection joint between the first and second sections of pipe, and power tong support means for supporting the power tong above the back-up tong; and control means for controlling the operation of the support assembly and of the power tong assembly.

Broadly stated, in some embodiments, the vertical riser assembly can further comprise: a substantially vertical outer tube member further comprising at least one mounting bracket configured for attaching the outer tube member to the drilling rig; a substantially vertical slot disposed along the outer tube member; an inner tube member having upper and lower ends, the inner tube member slidably disposed in the outer tube member and configured for upward and downward movement within the outer tube member; means for moving the inner tube member upwards and downwards relative to the outer tube member; and attachment means for pivotally attaching the swing arm assembly, the attachment means disposed on the inner tube member and further configured to extend through the slot wherein the power tong assembly can be raised or lowered relative to the vertical riser member when the swing arm assembly is pivotally attached to the attachment means and when the inner tube member moves upwards or downwards within the outer tube member.

Broadly stated, in some embodiments, the means for moving the inner tube member can further comprise a first telescoping member operatively coupled between the inner tube member and the outer tube member wherein the inner tube member can move upwards or downwards as the first telescoping member extends or retracts.

Broadly stated, in some embodiments, the attachment means can further comprise an upper pivot bracket disposed near the upper end of the inner tube member and a lower pivot bracket disposed near the lower end of the inner tube member. In further embodiments, the lower pivot bracket can further comprise an offset arm.

Broadly stated, in some embodiments, the apparatus can further comprise a second telescoping member operatively coupled between the offset arm and the swing arm assembly wherein the swing arm assembly can pivot in the substantially horizontal plane when the second telescoping member extends or retracts.

Broadly stated, in some embodiments, the swing arm assembly can further comprise: a fixed horizontal member configured to operatively couple with the attachment means; a telescoping horizontal member operatively coupled to the fixed horizontal member, wherein the telescoping horizontal member is configured to extend from and retract towards the fixed horizontal member; and a third telescoping member operatively coupled to the fixed and telescoping horizontal members wherein the telescoping horizontal member can extend from and retract towards the fixed horizontal member when the third telescoping member extends and retracts Broadly stated, in some embodiments, the back-up tong can further comprise: a first frame comprising a first opening configured to receive the first section of pipe; and a back-up jaw assembly configured for receiving and grasping the first section of pipe.

Broadly stated, in some embodiments, the back-up jaw assembly can further comprise: a pair of back-up jaw carriers operatively coupled together via a hinge, the back-up jaw carriers operatively attached to the first frame, the back-up jaw carriers disposed about the first opening, each back-up jaw carrier comprising a first jaw block configured for gripping the first section of pipe; a back-stop jaw block disposed near the hinge; and means for closing the pair of back-up jaw carriers wherein the first section of pipe is grasped by the first jaw blocks and the back-stop jaw block.

Broadly stated, in some embodiments, the means for closing the pair of back-up jaws can further comprise: a pincer assembly operatively coupled to the first frame and to the pair of back-up jaws; and a third telescoping member disposed on the pincer assembly wherein the pair of back-up jaws closes or opens when the third telescoping member extends or retracts.

Broadly stated, in some embodiments, one or more of the first, second and third telescoping members can further comprise a hydraulic cylinder.

Broadly stated, in some embodiments, the back-up assembly can further comprise three telescoping back-up jaw blocks disposed about the first opening. In further embodiments, one or more of the telescoping back-up jaw blocks can further comprise a hydraulic ram mechanism.

Broadly stated, in some embodiments, the power tong further comprises: a second frame comprising a second opening configured to receive the second section of pipe; a jaw drive assembly rotatably disposed in the second frame, the jaw drive assembly configured for receiving, grasping and rotating the second section of pipe; and drive means for rotating the jaw drive assembly.

Broadly stated, in some embodiments, the drive means can further comprise: a drive motor; a gear reducer operatively coupled to the drive motor; a drive shaft operatively coupled to the gear reducer; a drive sprocket or pulley disposed on the drive shaft; and a drive chain or belt operatively coupling the drive sprocket or pulley to the jaw drive assembly. In some embodiments, the drive motor can further comprise a hydraulic motor.

Broadly stated, in some embodiments, the jaw drive assembly can further comprise: an upper jaw ring configured to receive the second section of pipe; a lower jaw ring configured to receive the second section of pipe, the lower jaw ring operatively coupled to the upper jaw ring in a spaced-apart configuration; a jaw cam rotatably disposed between the upper and lower jaw rings, the jaw cam configured to be rotated by the drive means, the jaw cam comprising a cam opening further comprising a cam profile disposed thereon; a pair of jaws pivotally disposed between the upper and lower jaw rings within the cam opening, the pair of jaws disposed against the cam profile, each jaw further comprising a second jaw block configured for gripping the second section of pipe; and a rear jaw block disposed in the cam opening wherein the rear jaw block and the second jaw blocks are in are in a spaced-apart configuration about the cam opening, the rear jaw block disposed against the cam opening whereupon the jaw cam is rotated relative to the upper and lower jaw rings, the cam profile urges the rear jaw block and the pair of jaws inwardly to grasp and rotate the second section of pipe. In further embodiments, the jaw cam can further comprise means for being driven by the drive means.

Broadly stated, in some embodiments, the means for being driven can further comprise teeth disposed on an outer circumferential edge of the jaw cam, the teeth configured for engaging with the drive chain. In other embodiments, the means for being driven can further comprise a pulley disposed on an outer circumferential edge of the jaw cam, the pulley configured for engaging with the drive belt.

Broadly stated, in some embodiments, the power tong support means can further comprise: a plurality of guide rod receivers disposed on a top surface of the back-up tong; a plurality of guide rods extending downwardly from the second frame, wherein the guide rods are slidably disposed in the guide rod receivers; and a plurality of support springs, one support spring disposed on each guide rod, the support springs further disposed between the power tong and the back-up tong, and further configured to suspend the power tong above the back-up tong.

Broadly stated, in some embodiments, the control means can further comprise:

means for supplying a source of motive power for the support assembly and the power tong assembly, wherein the source of motive power is selected from a group consisting of a pneumatic supply system and a hydraulic fluid supply system; and means for controlling the source of motive power, the controlling means operatively coupling the source of motive power to the support assembly and the power tong assembly. In further embodiments, the controlling means can further comprise a plurality of manually operated valves. In yet further embodiments, the controlling means can further comprise a plurality of controllable valves.

Broadly stated, in some embodiments, the controlling means can further comprise a programmable logic controller configured to operatively control the controllable valves. In further embodiments, the controlling means can further comprise an operator's console operatively coupled to the programmable logic controller, wherein the console can further comprise a joystick mechanism configured for operatively controlling the programmable logic controller.

DETAILED DESCRIPTION OF EMBODIMENTS

Figure 1:
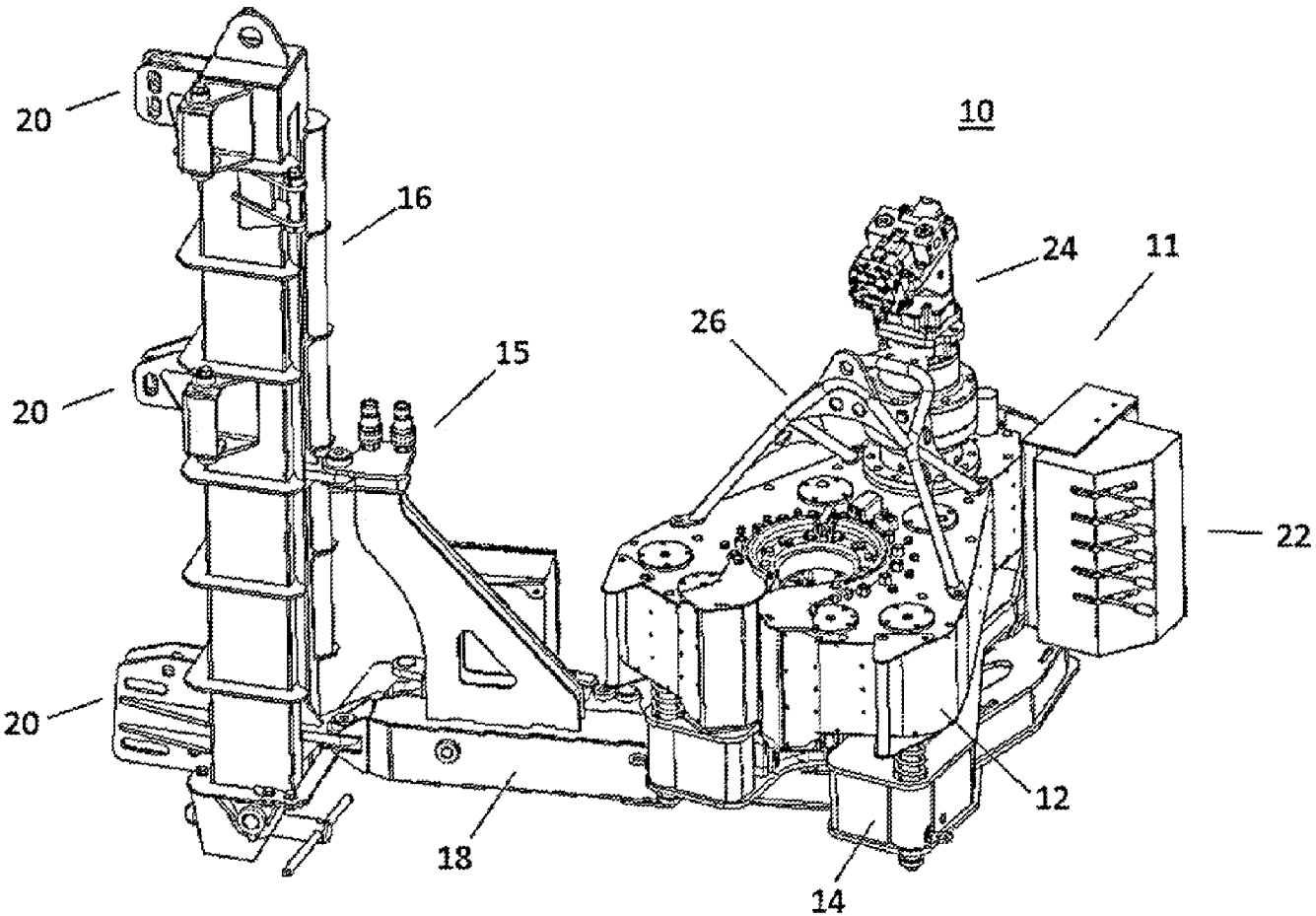
FIG. 1 is a perspective view depicting one embodiment of a power tong assembly.
Figure 2:
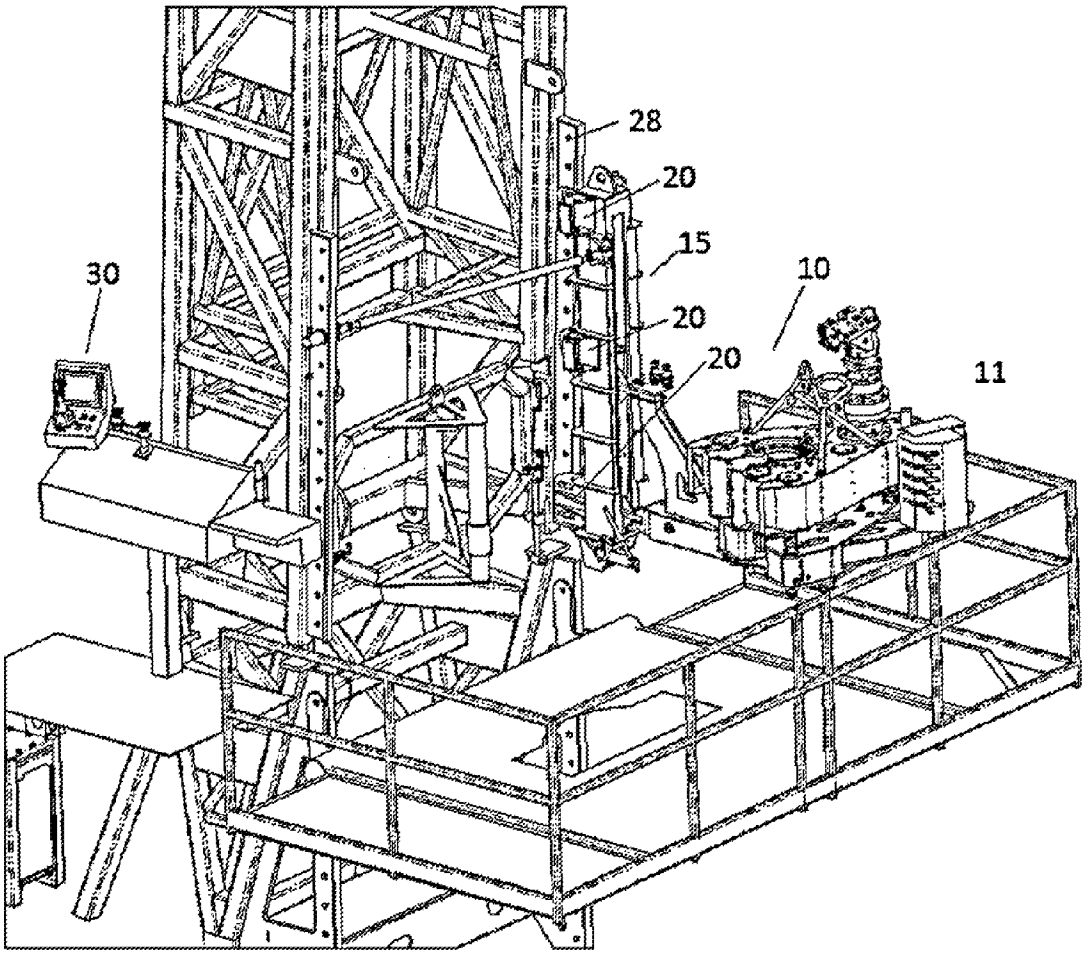
FIG. 2 is a perspective view depicting the power tong assembly of FIG. 1 installed on a drilling rig.

A power tong apparatus is provided. Referring to FIG. 1, one embodiment of power tong apparatus 10 is shown. In some embodiments, apparatus 10 can comprise of support assembly 15 and power tong assembly 11 operatively attached thereto. In some embodiments, support assembly 15 can further comprise of vertical riser assembly 16 and swing arm assembly 18 pivotally attached thereto. Vertical riser assembly 16 can further comprise brackets 20 disposed thereon for mounting apparatus 10 to drilling rig 28, as shown in FIG. 2. In some embodiments, power tong assembly 11 can further comprise power tong 12, back-up tong 14, drive assembly 24 and hydraulic valve bank 22 for manually controlling the operation of apparatus 10. Power tong assembly 11 can further comprise lifting frame 26 disposed on power tong 12 for lifting power tong assembly 11. Referring to FIG. 2, apparatus 10 can further comprise driller's console 30, which is operatively coupled to apparatus 10 to operate apparatus 10 from a remote locate on drilling rig 28.

Figure 3:
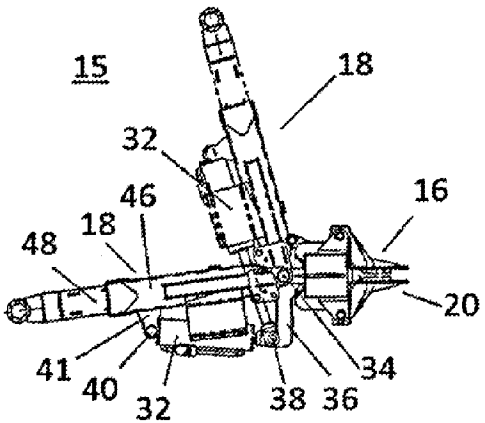
FIG. 3 is a top plan view depicting the swing arm assembly of the power tong assembly of FIG. 1.
Figure 4:
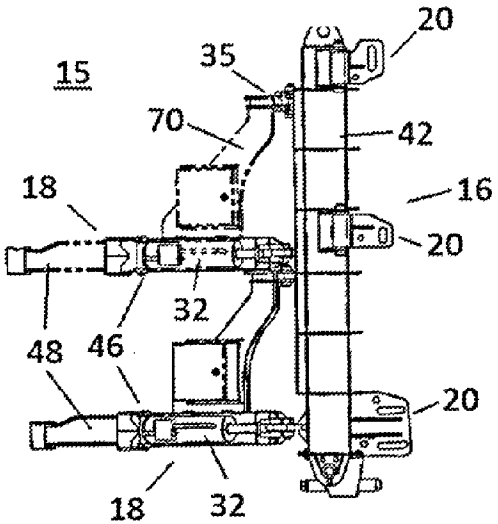
FIG. 4 is a side elevation view depicting the swing arm assembly of FIG. 3.
Figure 5:
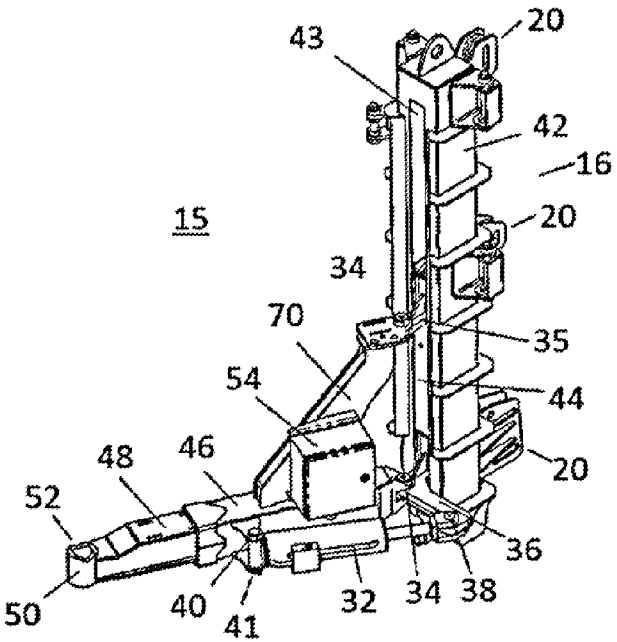
FIG. 5 is a perspective view depicting the swing arm assembly of FIG. 3.
Figure 7:
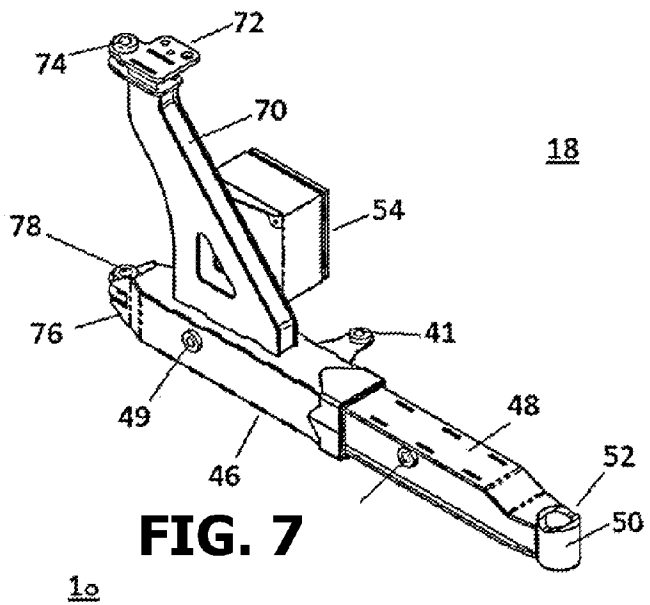
FIG. 7 is a perspective view depicting the swing arm assembly of FIG. 3.
Figure 6:
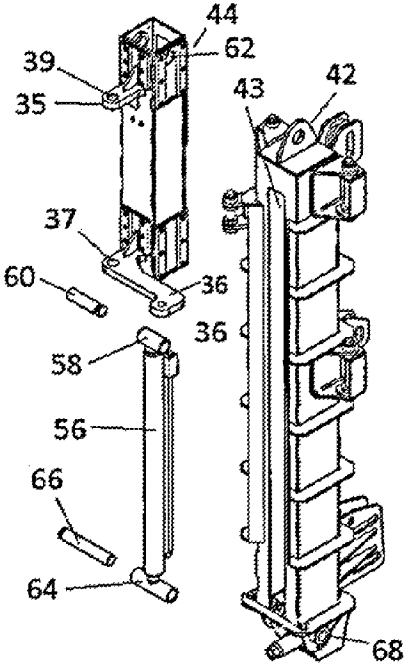
FIG. 6 is an exploded perspective view depicting the vertical riser assembly of the swing arm assembly of FIG. 3.

Referring to FIGS. 3 to 8, some embodiments of support assembly 15 and its sub-components are shown in more detail. Referring to FIG. 6, vertical riser assembly 16 is shown. In some embodiments, vertical riser assembly 16 can comprise of outer tube 42 and inner tube 44 slidably disposed therein. In the illustrated embodiments, outer tube 42 and inner tube 44 are shown having a rectangular cross-sectional shape although any suitable shape can be substitutes as obvious to those skilled in the art. In some embodiments, inner tube 44 can comprise upper arm 35 and lower offset arm 36 that can extend through slot 43 disposed along the vertical length of outer tube 42 when inner tube 44 is slidably disposed in outer tube 42. Vertical riser assembly 16 can further comprise telescoping member 56 operatively coupled between inner box 44 and outer box 42 by pin 66 inserted into tube 64 through holes 68, and secured therein, and by pin 66 inserted into tube 58 through holes 62, and secured therein. Therefore, when telescoping member 56 is extended, inner tube 44 can move upwards within outer tube 42 thereby raising swing arm assembly 18, and when telescoping member 56 retracts, inner tube 44 can move downwards within outer tube 42 thereby lowering swing arm assembly 18, as shown in FIG. 4.

Figure 8:
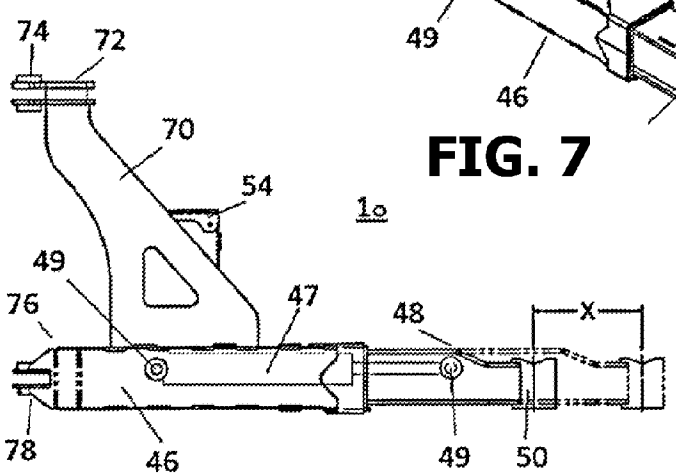
FIG. 8 is a side elevation view depicting the swing arm assembly of FIG. 7.

In some embodiments, swing arm assembly 18 can comprise swing arm 46, diagonal member 70 disposed on swing arm 46 and inner arm 48 slidably disposed within swing arm 46. Swing arm assembly 18 can further comprise telescoping member 47 operatively coupled between swing arm 46 and inner arm 48 and secured with pins 49, as shown in FIG. 8. Therefore, when telescoping member 47 is extended, inner arm 48 can extend outwardly from swing arm 46 a distance "X", as shown in FIG. 8. When telescoping member 47 retracts, inner arm 48 can retract into swing arm 46. In some embodiments, "X" can represent a distance of approximately 8 to 12 inches. Swing arm 46 can further comprise lower bracket 76 having holes 78 for pivotal attachment to offset arm 36, which can be secured by pin 34 set through and secured in holes 78 disposed on bracket 76 and hole 37 disposed on offset arm 36. Diagonal member 70 can further comprise upper bracket 72 having holes 74 for pivotal attachment to upper arm 35, which can be secured by pin 34 set through and secured in holes 74 disposed on bracket 72 and hole 39 disposed on upper arm 35. In some embodiments, junction box 54 can be disposed on swing arm assembly 18 to house power cable connections, and electrical control and instrumentation cable connections to and from a programmable logic controller configured to control the operation of power tong apparatus 10, to and from valve bank 22, and to and from operator console 30.

Figure 27:
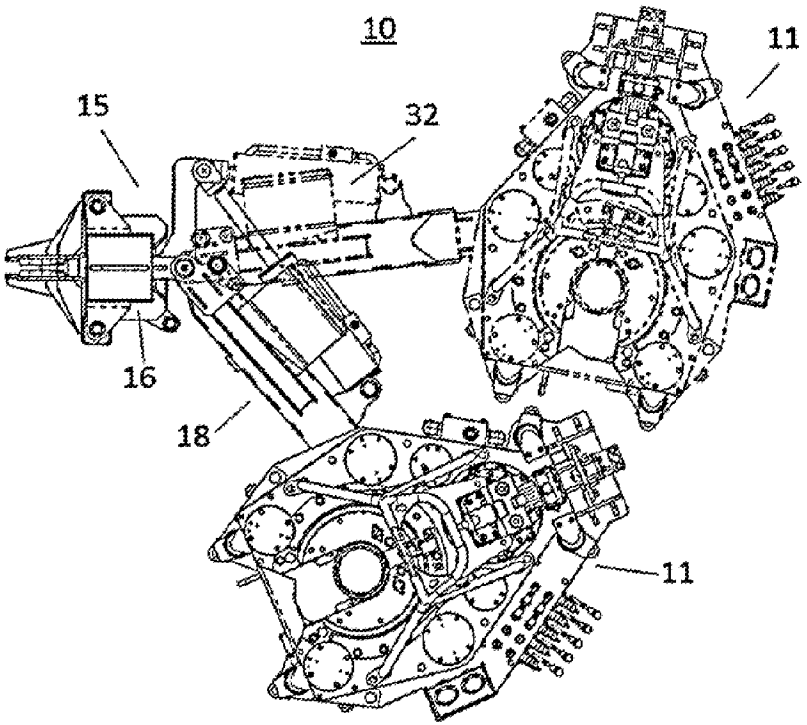
FIG. 27 is a top plan view depicting the power tong assembly of FIG. 26 in a fully retracted horizontal position, and in a fully extended horizontal position.

Referring to FIG. 5, swing arm assembly 18 is shown pivotally attached to vertical riser assembly 16. In some embodiments, telescoping member 32 can be coupled to bracket 41 disposed on swing arm 46 with pin 40, and can further be coupled to offset arm 36 with pin 38. Therefore, when telescoping member 32 is extended, swing arm assembly 18 can rotate or swing clockwise (when viewed from above), and when telescoping member 32 retracts, swing arm assembly 18 can rotate or swing counter-clockwise, as shown in FIGS. 3 and 27.

In some embodiments, telescoping members 32, 47 and 56 can comprise hydraulic ram cylinders, as well known to those skilled in the art, although in other embodiments, these telescoping members can comprise pneumatic ram cylinders, as well known to those skilled in the art.

Figure 10:
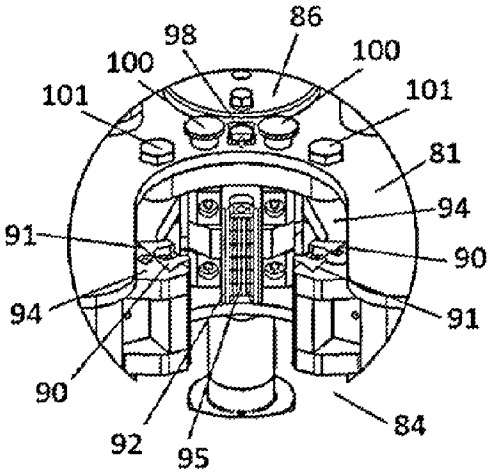
FIG. 10 is a close-up perspective view depicting the jaw assembly of the backup tong of FIG. 9.
Figure 9:
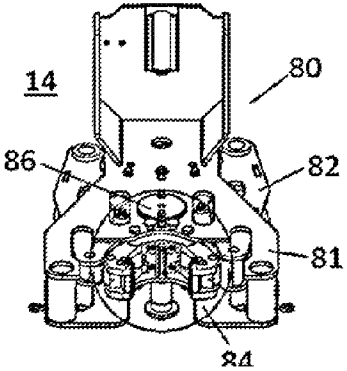
FIG. 9 is a perspective view depicting one embodiment of a backup tong of the power tong assembly of FIG. 1.
Figure 11:
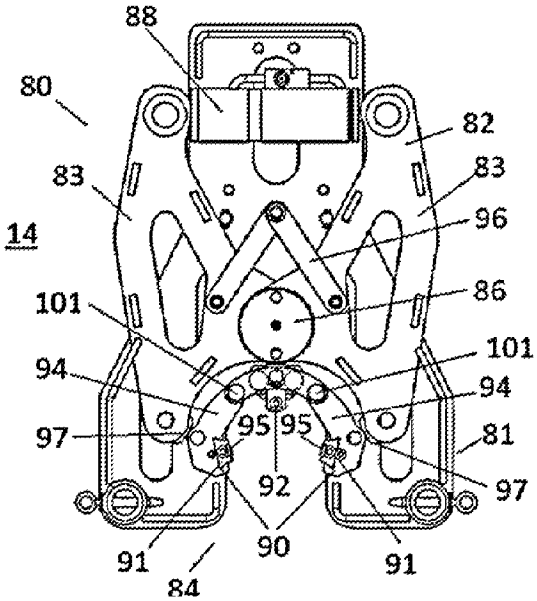
FIG. 11 is a top plan view depicting the backup tong of FIG. 9 with the top plate removed to reveal the jaw mechanism disposed therein.

Referring to FIGS. 9 to 11, one embodiment of back-up tong 14 is shown. In some embodiments, back-up tong 14 can comprise back-up tong assembly 80 that can further comprise frame 81, pincer assembly 82 pivotally attached to frame 81 via pivot pin 86 and back-up jaw assembly 84. In some embodiments, back-up jaw assembly 84 can further comprise hinged back-up jaw carriers 94 attached to frame 81 via jaw pins 100 and bolts 101, wherein each jaw carrier 94 can comprise slot 91 configured for receiving jaw block 90, which can be configured with a removable die 95. In some embodiments, back-up jaw assembly 84 can further comprise backstop 92, which can further comprise removable die 95. In some embodiments, backstop 92 can be removably attached to back-up jaw assembly 84 via quick release pin 98. This can enable easy replacement of backstop 92 with different sizes of backstops 92 to accommodate different diameters of pipe. In addition, different sizes or configurations of jaw carriers 94 can be installed to accommodate different diameters of pipe.

In some embodiments, pincer assembly 82 can comprise telescoping member 88 disposed between arms 83. When telescoping member 88 is extended, arms 83 can pivot about pivot pin 86 to contact jaw carriers 94 at contact point 97 that, in turn, can close about a section of pipe disposed there between. Centering linkage 96 coupled between arms 83 can help jaw carriers 94 to grip the pipe such that it is centered between jaw carriers 94 and backstop 92. In some embodiments, telescoping member 88 can comprise a hydraulic or pneumatic ram cylinder, as well known to those skilled in the art.

Figure 13:
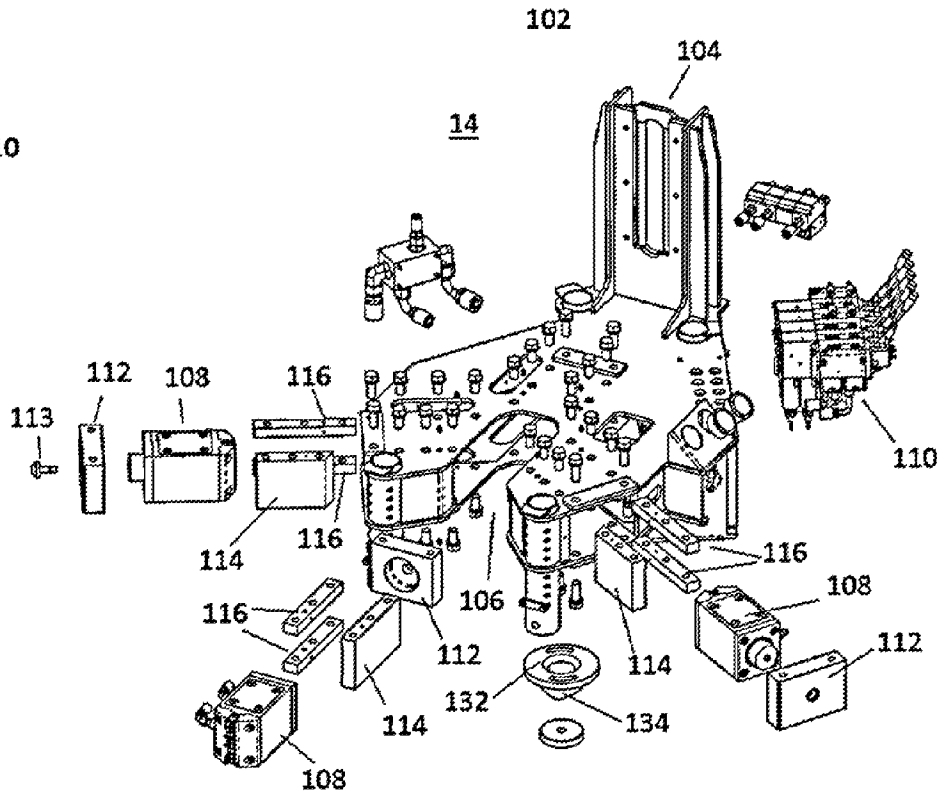
FIG. 13 is an exploded perspective view depicting the backup tong of FIG. 12.
Figure 12:
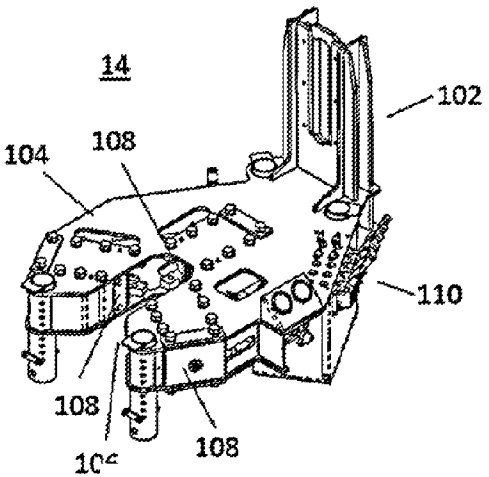
FIG. 12 is a perspective view depicting an alternate embodiment of a backup tong of the power tong assembly of FIG. 1.
Figure 14:
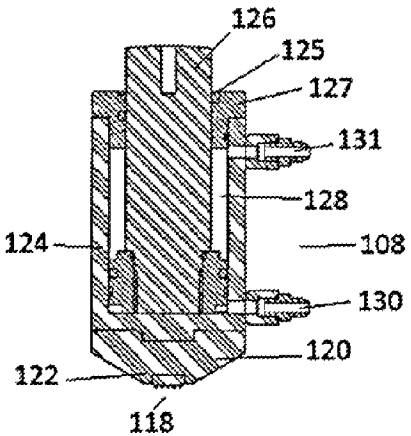
FIG. 14 is a top plan cross-section view depicting a hydraulically-actuated jaw of the backup tong of FIG. 13.

Referring to FIGS. 12 to 14, a second embodiment of back-up tong 14 is shown. In some embodiments, back-up tong 14 can comprise back-up tong assembly 102 that can further comprise of frame 104 having throat 106 configured for receiving a section of pipe. Frame 102 can further comprise valve bank 110 for manually controlling the operation of apparatus 10. Back-up tong assembly 102 can further comprise a plurality of ram jaws 108 disposed about opening 106. In the illustrated embodiment, there can be three ram jaws 108 positioned in a substantially equal spaced-apart configuration about opening 106. In some embodiments, each ram jaw 108 can be slidably disposed in frame 104 by guide track 114, guide rails 116 and end block 112 operatively attached to frame 104. Referring to FIG. 14, each ram jaw 108 can comprise housing 124 and piston 126 slidably disposed therein to form annular chamber 128. Piston 126 can extend through opening 125 disposed in end 127, and can further be fasted to end block 112 with fastener 113. Each ram jaw 108 can further comprise die face 120 having die slot 122 disposed thereon to receive removable die 118, which is configured with grooves or teeth to grip pipe. As die 118 wears out, it can be replaced with a new die 118. Fittings 130 and 131 can be coupled to a source of pressurized hydraulic fluid or air. In operation, pressurized fluid or air introduced into chamber 128 through fitting 130 can force piston 126 to extend out from opening 125 and contact end block 112. This can force housing 124 to travel along guide track 114 and guide rails 116 towards throat opening 106 to grip a section of pipe. When pressurized fluid or air introduced into chamber 128 through fitting 131, piston 126 can be retracted into housing 124 thereby drawing ram jaw 108 back along guide track 114 and guide rails 116 away from throat opening 106 to release the pipe.

In some embodiments, back-up tong 14 can comprise centering pin 132 having v-shaped profile 134 disposed thereon, profile 134 can be configured to match the profile of detent 52 of pivot tube 50 disposed on inner arm 48 of swing arm assembly 18. Therefore, when back-up tong 14 is pivotally attached to pivot tube 50, profile 134 can fit in detent 52 and can further act as means to center power tong assembly 11 in a desired orientation with respect to swing arm assembly 18.

Figure 17:
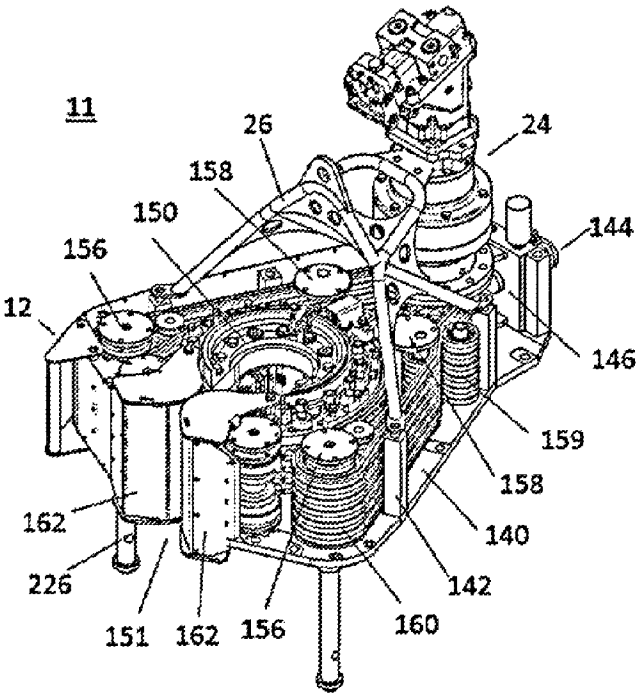
FIG. 17 is a perspective view depicting the power tong of FIG. 15 with a lifting arm attached, and a portion of the covers removed to reveal the drive mechanism disposed therein.
Figure 15:
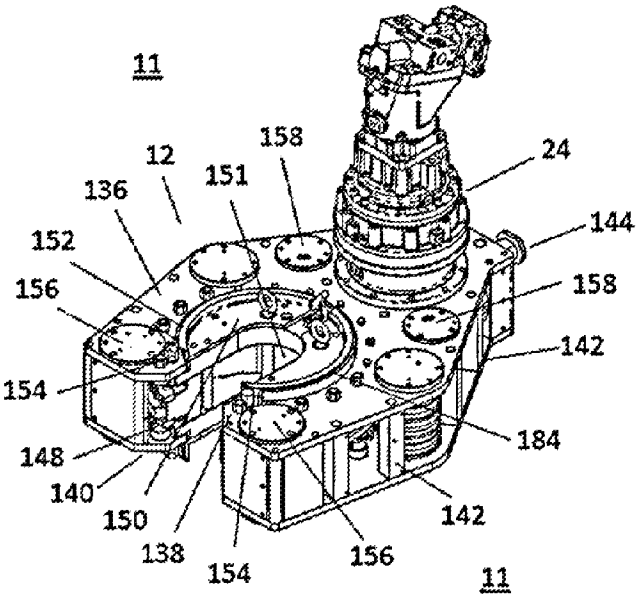
FIG. 15 is a perspective view depicting the power tong of the power tong assembly of FIG. 1.
Figure 16:
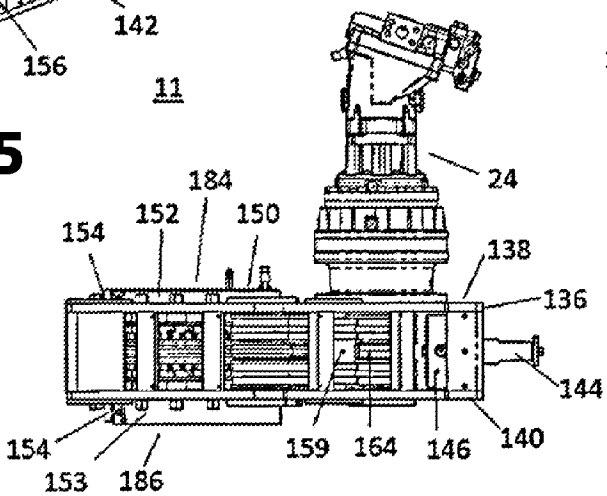
FIG. 16 is a side elevation view depicting the power tong of FIG. 15.

Referring to FIGS. 15 to 17, an embodiment of power tong assembly 11 is shown. In some embodiments, power tong 12 can comprise of frame 136 further comprising of top plate 138 and bottom plate 140 joined together by support posts 142 disposed around the perimeter of frame 136. In some embodiments, jaw assembly 150 can be rotatably disposed in frame 136 between top plate 138 and bottom plate 140 and can further form jaw opening 151 to receive a section of pipe. In some embodiments, drive assembly 24 can provide the motive power to rotate jaw assembly 150 via drive chain 160 driven by drive sprocket 164, wherein drive chain 160 can be guided by idler posts 156 and 159, and by tensioner posts 158, to engage and rotate jaw assembly 150. In some embodiments, drive chain 160 can comprise a 6-row, #80 roller chain. In some embodiments, drive chain 160 can pass between idler posts 159 and tensioner posts 158, wherein tensioner posts 158 can comprise an eccentric mechanism to move tensioner posts 158 against drive chain 160 to remove any slack in the chain.

In some embodiments, power tong 12 can further comprise upper brake band 152 disposed around upper brake hub 184 disposed on jaw assembly 150. In some embodiments, power tong 12 can further comprise lower brake band 153 disposed around lower brake hub 186. Brake band posts 154 can be disposed on top plate 138 and bottom plate 140 to control the movement of upper brake band 152 and lower brake band 153 when jaw assembly 150 is rotated. In some embodiments, frame 136 can further comprise torque reactor 144 disposed thereon, and load cell 146, operatively coupled to a programmable logic controller or other monitoring electronics (not shown) as well known to those skilled in the art to measure the torque applied to pipe when disposed in jaw opening 151 by power tong 12. In some embodiments, power tong 12 can further comprise guards 162 disposed on frame 136 near jaw opening 151 that can be configured to open to receive a section of pipe, and to close when the pipe is within jaw assembly 150 as safety means to protect personnel from the rotating components of power tong 12 when in operation.

Figure 18:
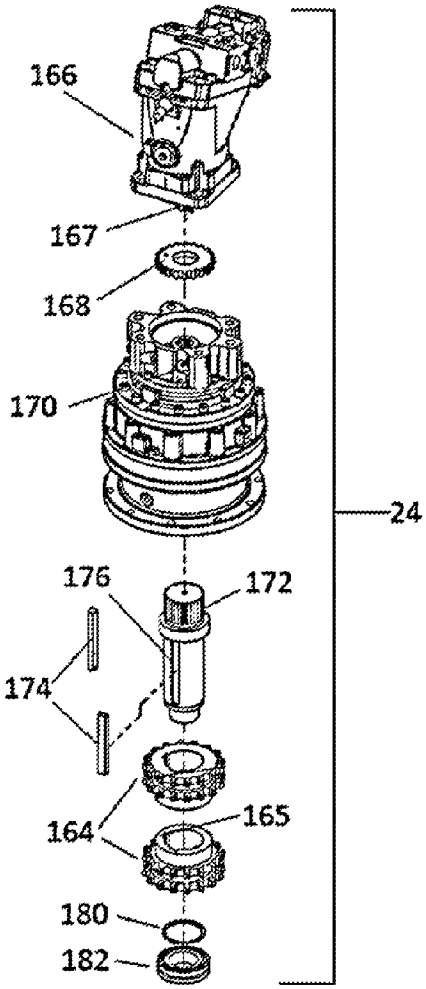
FIG. 18 is a perspective exploded view depicting the hydraulic motor assembly of the power tong of FIG. 15.

Referring to FIG. 18, one embodiment of drive assembly 24 is shown. In some embodiments, drive assembly 24 can comprise motor 166 operatively coupled to gear reducer 170. In some embodiments, motor 166 can comprise a variable speed hydraulic motor. In using such a motor, power tong apparatus 10 can avoid the necessity of changing gears using a conventional 2-speed transmission, which can avoid overtorquing a joint between sections of pipe when the transmission is shifted from high gear to low gear to apply the final torque. In this situation, starting in low gear can require overcome the static friction in the connection to reach the desired torque for the connection. In a representative embodiment, a Series 51, 80 cc bent-axis hydraulic motor as manufactured by Sauer-Danfoss Gmbh & Co. OHG of Neumünster, Germany can be used as motor 166, although functionally equivalent motors can be used, as well known to those skilled in the art. In some embodiments, gear reducer 170 can comprise a Model 25D planetary gear reducer as manufactured by Heco Gear of West Sacramento, Calif., U.S.A. In some embodiments, encoder ring 168 can be disposed between motor 166 and gear reducer 170 as a means for monitoring the rotational speed of output shaft 167, in combination with sensors disposed in gear reducer 170 (not shown) as well known to those skilled in the art. In some embodiments, drive assembly 24 can further comprise drive shaft 172 operatively coupled to gear reducer 170, which can be further operatively coupled to drive sprockets 164 via keys 174 disposed between slot 176 disposed on driveshaft 172 and slots 165 disposed in drive sprockets 164. In some embodiments, drive sprockets 164 can be retained on driveshaft 172 by snap ring 180, and supported by idler bearing 182 when disposed in frame 136.

Figure 19A:
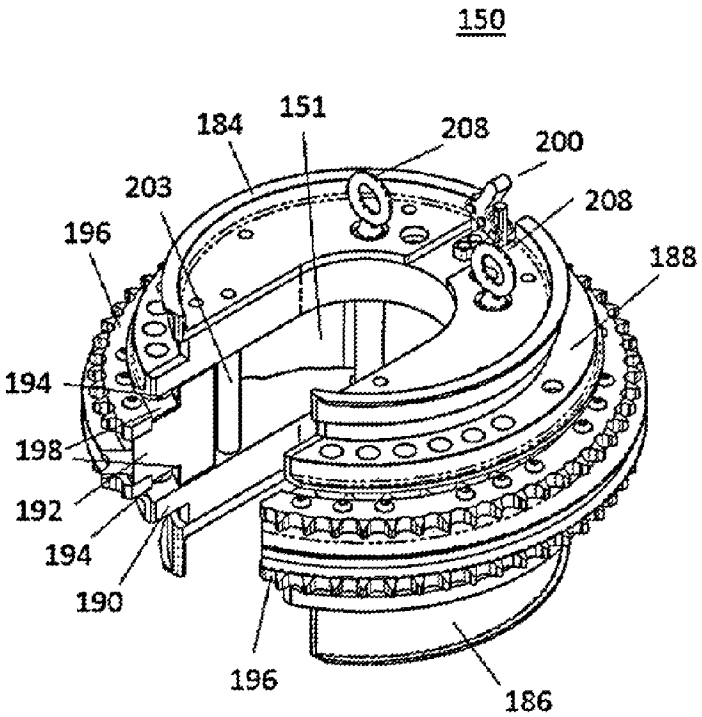
FIG. 19A is a perspective view depicting the jaw assembly of the power tong of FIG. 15, wherein the jaw cam is centered with the upper and lower jaw rings.
Figure 20:
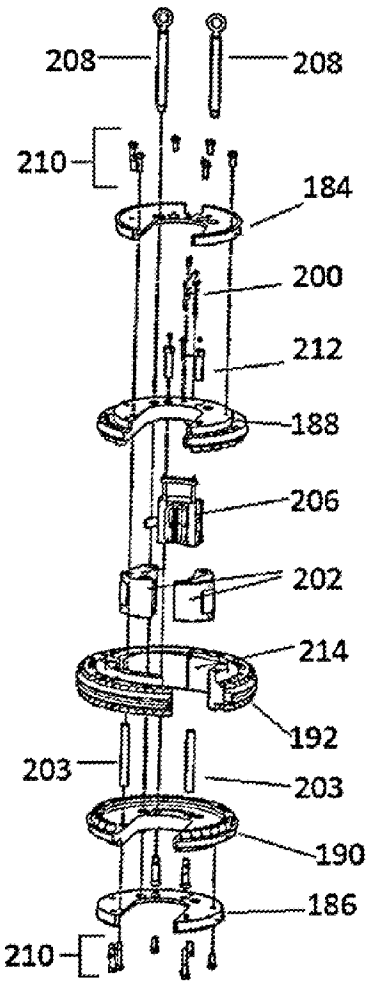
FIG. 20 is a perspective exploded view depicting the jaw carrier of FIGS. 19A and 19B.
Figure 19B:
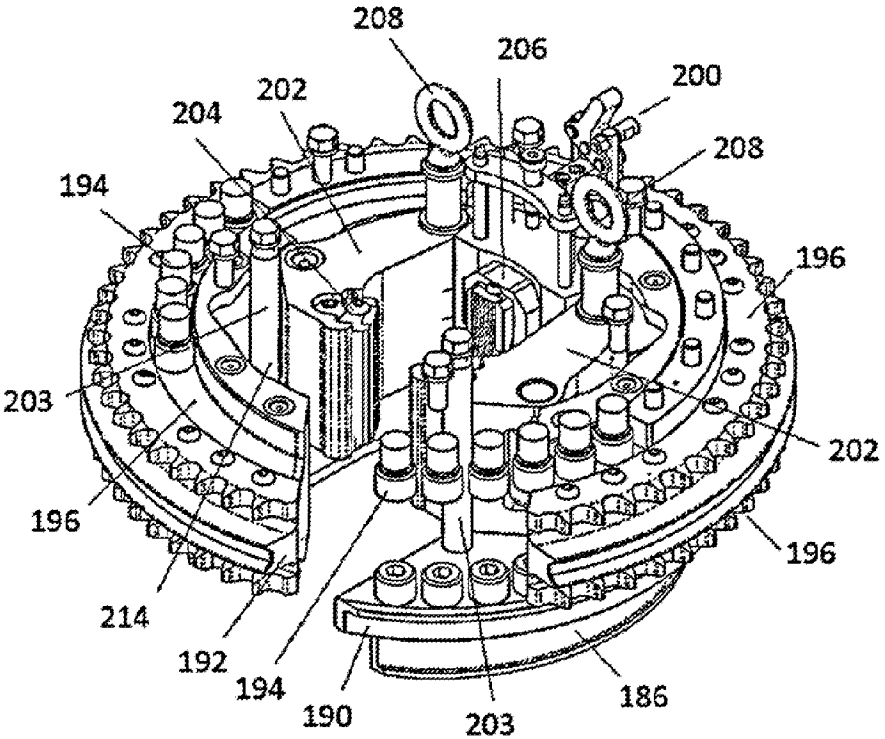
FIG. 19B is a perspective view depicting the jaw assembly of FIG. 19A with the upper jaw ring removed to reveal the mechanism disposed therein, wherein the jaw cam is rotated counter-clockwise relative to the lower jaw ring.

Referring to FIGS. 19A, 19B and 20, an embodiment of jaw assembly 150 is shown. In some embodiments, jaw assembly 150 can comprise of upper jaw ring 188 and lower jaw ring 190 operatively coupled together with rod spacers 203 and eye bolts 208. In further embodiments, jaw assembly 150 can further comprise jaw cam 192 rotatably disposed between upper jaw ring 188 and lower jaw ring 190. Each of upper jaw ring 188, lower jaw ring 190 and jaw cam 192 can each further comprise an opening that can align together to form jaw opening 151. In some embodiments, upper jaw ring 188 can comprise upper brake hub 184 disposed on an upper surface of upper jaw ring 188 and attached with fasteners 210, and lower jaw ring 190 can comprise lower brake hub 186 disposed on a lower surface of lower jaw ring 190 and attached with fasteners 210. Upper jaw ring 188 can further comprise grease fittings 212, wherein jaw assembly 150 can be lubricated with grease injected through fittings 212. In some embodiments, jaw cam 192 can comprise one or more sprockets 196 disposed on a circumferential edge thereof for engagement with drive chain 160. In some embodiments, drive chain 160 can be substituted with a functionally equivalent drive belt, wherein drive sprocket 164, sprockets 196, tensioner posts 158 and idler posts 159 can also be suitably modified for operation therewith, and further comprise pulleys configured for operation with a drive belt.

In some embodiments, jaw cam 192 can further comprise circumferential grooves 198 disposed on upper and lower surfaces thereof configured to receive rollers 194 that can travel therein. In some embodiments, rollers 194 can be disposed on a lower surface of upper jaw ring 188, and on an upper surface of lower jaw ring 190 to travel within grooves 198, wherein jaw cam 192 can rotate between upper and lower jaw rings 188 and 190.

Figure 22:
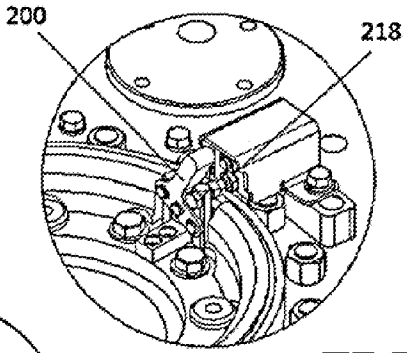
FIG. 22 is a close-up perspective view depicting the make/break selector mechanism of the jaw assembly of FIG. 19A.

In some embodiments, jaws 202 can be disposed within jaw opening 151 between upper jaw ring 188 and lower jaw ring 190, wherein jaws 202 can be pivotally attached to eye bolts 208. Each jaw 202 can further comprise a jaw block 204 configured to have a replaceable die 205 disposed thereon. Dies 205 can be configured with grooves or teeth so as to grip a pipe. Dies 205 can wear out over time, whereupon worn out dies 205 can then be replaced with new dies 205. In some embodiments, jaw assembly 150 can further comprise rear jaw block 206 disposed between upper and lower jaw rings 188 and 190 near the back of jaw opening 151. Rear jaw block 206 can further comprise rear jaw carrier 207 slidably disposed therein, wherein rear jaw carrier 207 can further comprise a replaceable die 205 disposed thereon. In some embodiments, jaw assembly 150 can further comprise centering mechanism or switch 200 disposed on upper jaw ring 188 near rear jaw block 206. Centering mechanism or switch 200 can be used to switch the operation of power tong 12 between "make-up mode" (to join sections of pipe together) and "break-out mode" (to separate sections of pipe). In some embodiments, centering mechanism or switch 200 can further comprise proximity sensors 218 (see FIG. 22) operatively coupled to a programmable logic controller to detect what mode of operation power tong 12 is in, as well as when jaw cam 192 is centered with upper and lower jaw rings 188 and 190.

Figure 21B:
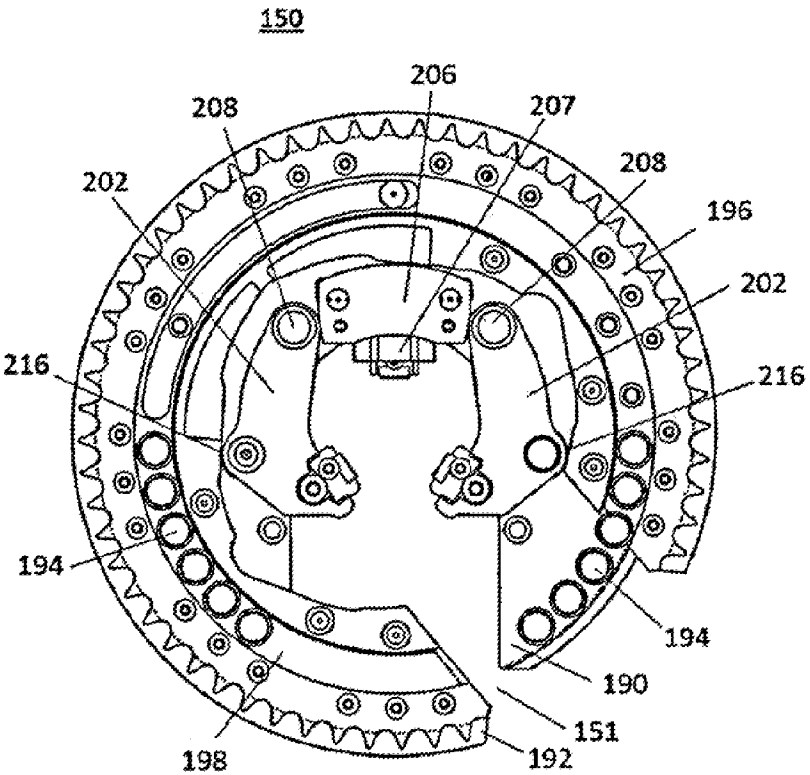
FIG. 21B is a top plan view depicting the jaw assembly of FIG. 19B.
Figure 21A:
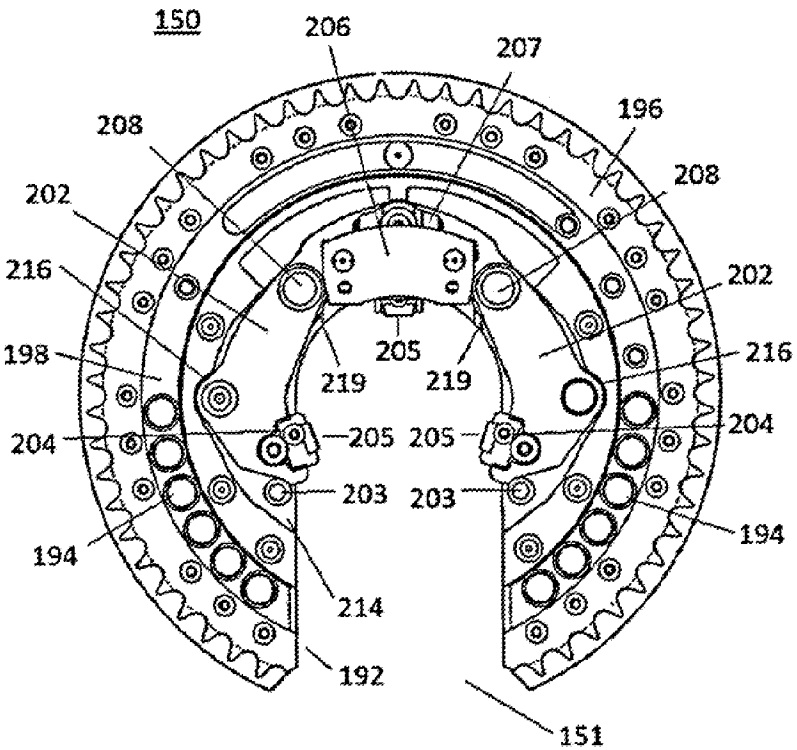
FIG. 21A is a top plan view depicting the jaw assembly of FIG. 19A.

Referring to FIGS. 21A and 21B, one embodiment of jaw assembly 150 is shown with upper jaw ring 188 removed to illustrate the operation of jaw assembly 150. In FIG. 21A, jaw cam 192 is shown centered with lower jaw ring 190, wherein jaw opening 151 is open to receive a section of pipe. In this position, biasing means 219 keep jaws 202 biased towards cam profile 214 disposed on an inner circumferential edge of jaw cam 192 to keep jaw opening 151 clear for the pipe. In some embodiments, biasing means 219 can comprise a spring. In some embodiments, jaws 202 can comprise rollers 216, wherein jaws 202 can roll against cam profile 214 when jaw cam 192 is rotated. When, for example, power tong 12 is in "break-out mode", drive assembly 24 can rotate jaw cam 192 counter-clockwise, as shown in FIG. 21B, by rotating chain 160 (as shown in FIG. 17) to engage sprockets 196. Brake bands 152 and 153 (as shown in FIGS. 15 and 16) can hold upper and lower jaw rings 188 and 190 in place so that jaw cam 192 can rotate relative to upper and lower jaw rings 188 and 190, and urge jaws 202, as they pivot about eye bolts 208, towards jaw opening 151 to grip a pipe disposed therein as rollers 216 follow cam profile 214. Brake band posts 154, as shown in FIGS. 15 and 16, can act to keep brake bands 152 and 153 in place while jaw assembly is rotating. In some embodiments, cam profile 214 can be configured to urge rear jaw carrier 207 towards jaw opening 151 to grip the pipe as well. Once jaws 202 and rear jaw carrier 207 grip the pipe, jaw cam 192 can be continued to be rotated by drive assembly 24 and chain 160 until a joint between a section of pipe and the drill string has been completely separated. At this point, drive assembly 24 can be reversed to center jaw cam 192 with upper and lower jaw rings 188 and 190, wherein jaws 202 and rear jaw carrier release the pipe so it can be removed from power tong 12. In "make-up mode", the procedure is reversed such that a section of pipe to be joined to the drill string is placed in the jaw opening 151 and jaw cam 192 can be rotated clockwise by drive assembly 24 to first engage and grip the pipe and then thread the pipe to the drill string to a desired torque, whereupon drive assembly 24 is reversed to center jaw cam 192 with upper and lower jaw rings 188 and 190 so that power tong 12 can move away from the drill string.

Figure 23:
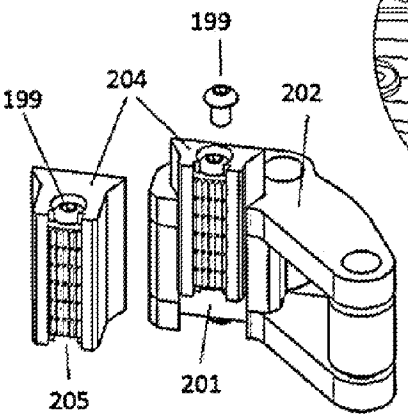
FIG. 23 is a perspective view depicting a jaw with a jaw block insert.
Figure 24:
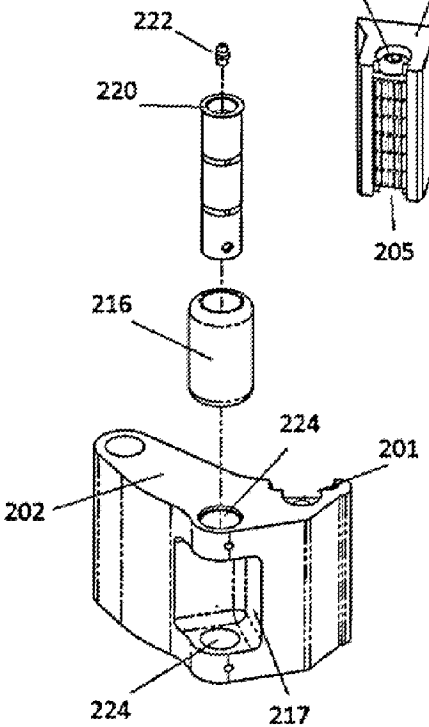
FIG. 24 is a perspective view depicting a first embodiment of a jaw.
Figure 25:
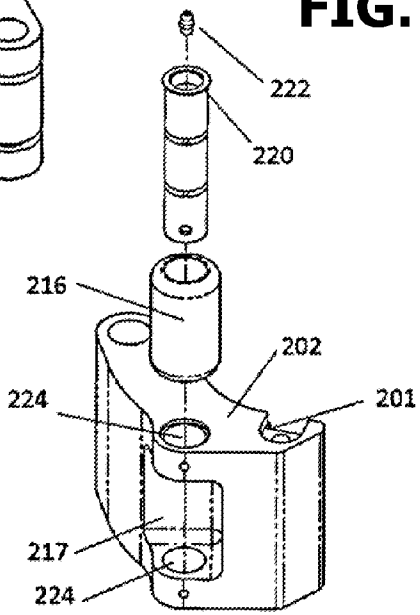
FIG. 25 is a perspective view depicting a second embodiment of a jaw.

Referring to FIGS. 23 to 25, some embodiments of jaw 202 are shown. Referring to FIG. 23, in some embodiments, jaw 202 can comprise slot 201 configured for receiving jaw block 204, which can be secured to jaw 202 with a fastener 199 secured to jaw 202. Jaw block 204 can further be configured to receive replaceable die 205, which can be secured to jaw block 204 with another fastener 199. Referring to FIGS. 24 and 25, in some embodiments, jaw 202 can further comprise roller recess 217 configured to receive jaw roller 216 rotatably disposed therein. In some embodiments, roller pin 220 can pass through holes 224 disposed in jaw 202 and jaw roller 216 and be secured to jaw 202, wherein jaw roller 216 can rotate within roller recess 217. In further embodiments, roller pin 220 can comprise grease fitting 222 to permit lubrication of jaw roller 216 so that it can freely rotate about roller pin 220. In FIG. 24, the embodiment of jaw 202 shown is configured to grip pipe having diameters ranging from 2⅜ inches to 4½ inches. In FIG. 25, the embodiment of jaw 202 shown is configured to grip pipe having diameters ranging from 5 inches to 5½ inches. In some embodiments, jaws 202 can be interchanged in jaw assembly 150 by removing eye bolts 208, placing the desired size of jaws 202 within jaw assembly 150 and reinstalling eye bolts 208.

Figure 26:
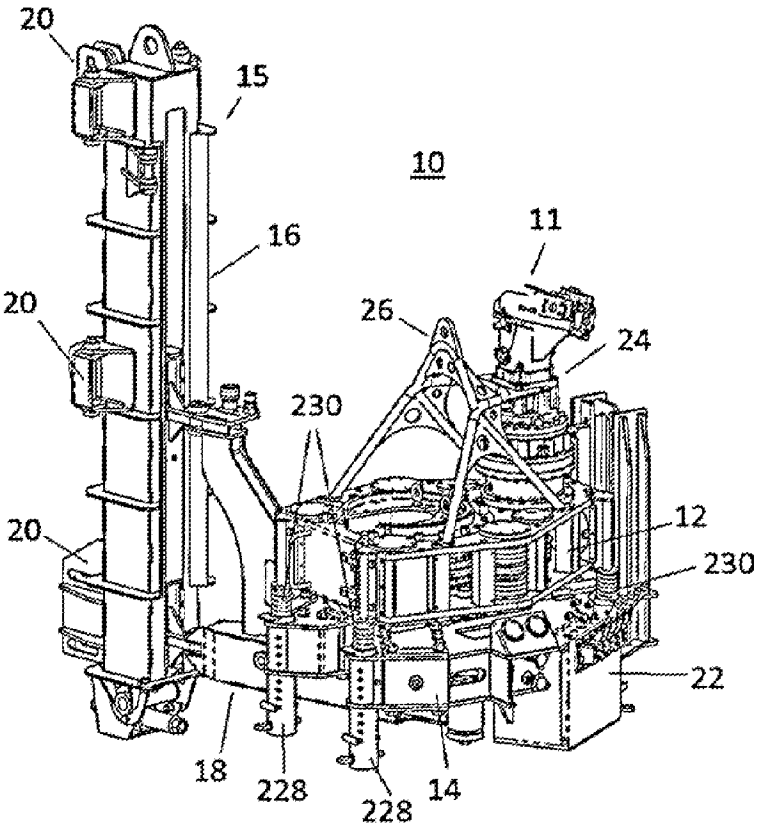
FIG. 26 is perspective view depicting a second embodiment of a power tong assembly.

Referring to FIG. 26, an embodiment of power tong apparatus 10 is shown. In some embodiments, power tong 12 can be supported above back-up tong 14 by a plurality of guide rods 226 extending downwardly from power tong 12 (as shown in FIG. 17) slidably disposed in guide rod receivers 228 disposed in back-up tong 14, and coil springs 230 disposed about guide rods 226 between power tong 12 and back-up 14. In a representative embodiment, power tong apparatus 10 can comprise three sets of guide rod 226, guide rod receiver 228 and spring 230 to support power tong 12 above back-up tong 14. With this configuration, power tong 12 can move upwards or downwards relative to back-up tong 14, depending on whether power tong apparatus 10 is being operated in a "bread-out mode" or "make-up mode."

Figure 28:
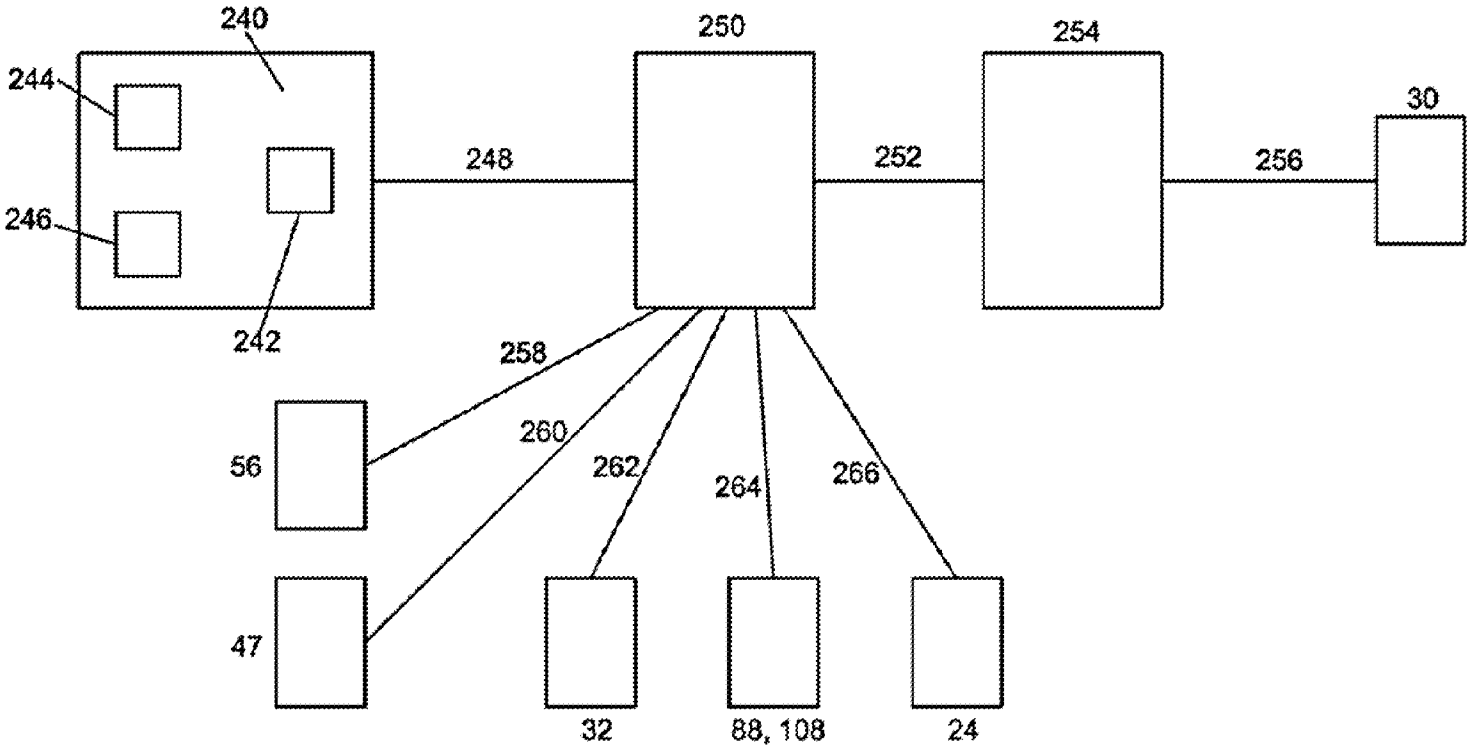
FIG. 28 is a block diagram depicting one embodiment of a control system for controlling the power tong assembly of FIG. 1.

Referring to FIG. 28, one embodiment of control system 238 for controlling the operation of power tong assembly 10 is shown. In some embodiments, control system 238 can comprise hydraulic power unit ("HPU") 240, which can further comprise of hydraulic pump 242 and hydraulic fluid tank 244. In further embodiments, HPU 240 can further comprise hydraulic fluid filtering system 246. In yet further embodiments, filtering system 246 can further comprise a hydraulic cooling system, which can comprise of a radiator or heat exchanger, to cool hydraulic fluid pumped by HPU 240. In some embodiments, HPU 240 can be configured to pump hydraulic fluid at a pressure of up to 3600 psi at a rate of up to 22 gallons per minute. In some embodiments, pump 242 can provide a hydraulic power rating of up to 29 horsepower. In some embodiments, control system 238 can comprise hydraulic send and return lines operatively coupled between HPU 240 and controllable valve bank 250, which can be operatively controlled by programmable logic controller ("PLC") 254 via control cable 252 disposed there between. Valve bank 250 can be controlled by PLC 254 to provide pressurized hydraulic fluid from HPU 240 to telescoping member 56, disposed in vertical riser assembly 16, via send and return hydraulic lines 258; to telescoping member 47, disposed in swing arm 46, via send and return hydraulic lines 260; to telescoping member 32, disposed on swing arm assembly 18, via send and return hydraulic lines 262; to telescoping member 88 disposed in back-up tong assembly 80, or to ram jaws 108 disposed in back-up tong assembly 102, depending on which embodiment of back-up tong 14 is disposed in power tong apparatus 10, via send and return hydraulic lines 264; and to drive assembly 24, via send and return hydraulic lines 266. In some embodiments, valve bank 250 can comprise model No. PVG32 hydraulic valves as manufactured by Sauer-Danfoss Gmbh & Co. OHG of Neumünster, Germany, although any functionally equivalent hydraulic valves as well known by those skilled in the art can be used. In some embodiments, PLC 254 can comprise a model CP1H PLC as manufactured by Omron Corporation of Kyoto, Japan, although any functionally equivalent PLC as well known by those skilled in the art can be used.

Figure 29A:
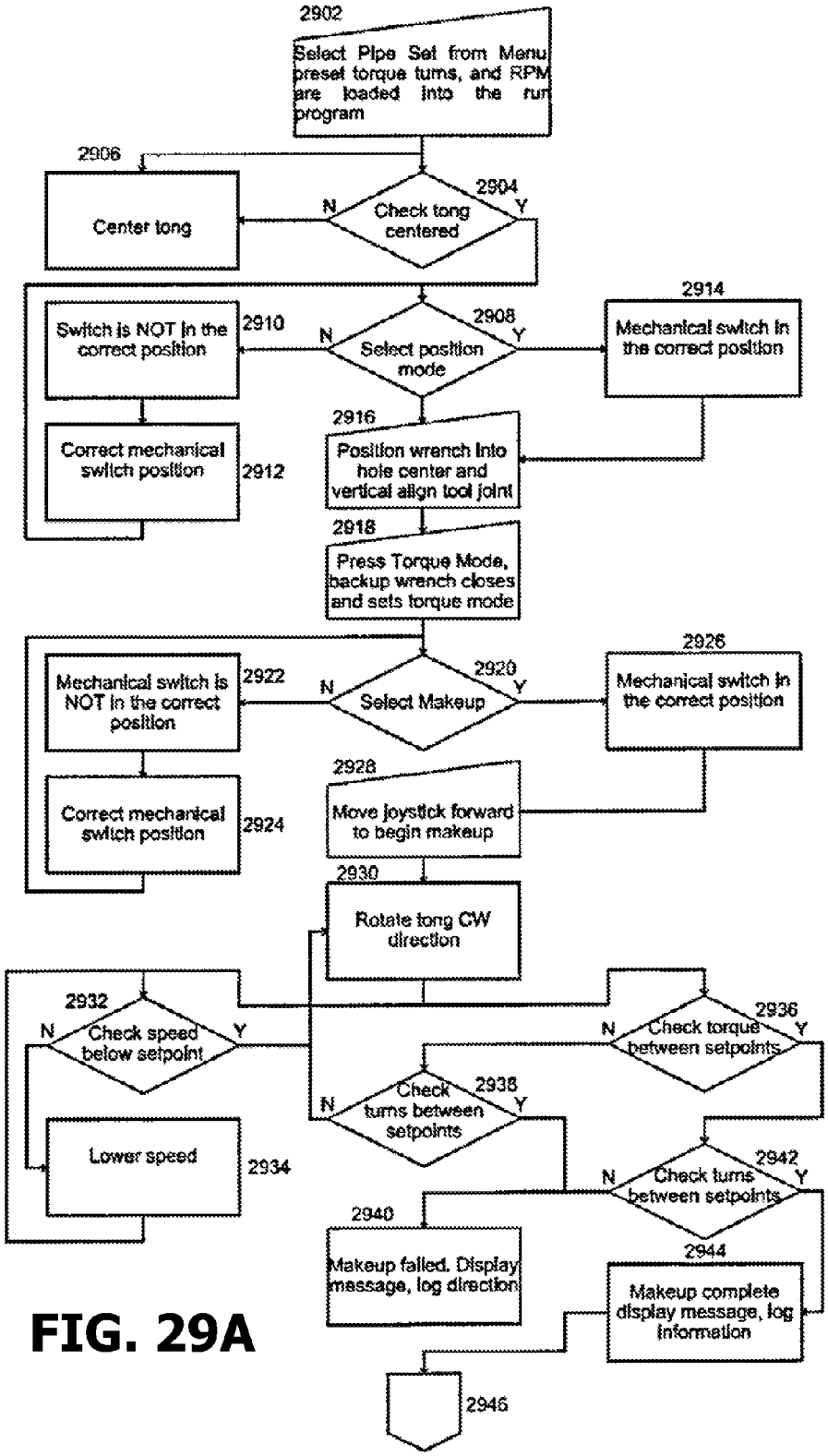
FIGS. 29A and 29B comprise a flowchart depicting a Manual Operation Make Mode of the control system of FIG. 28.
Figure 29B:
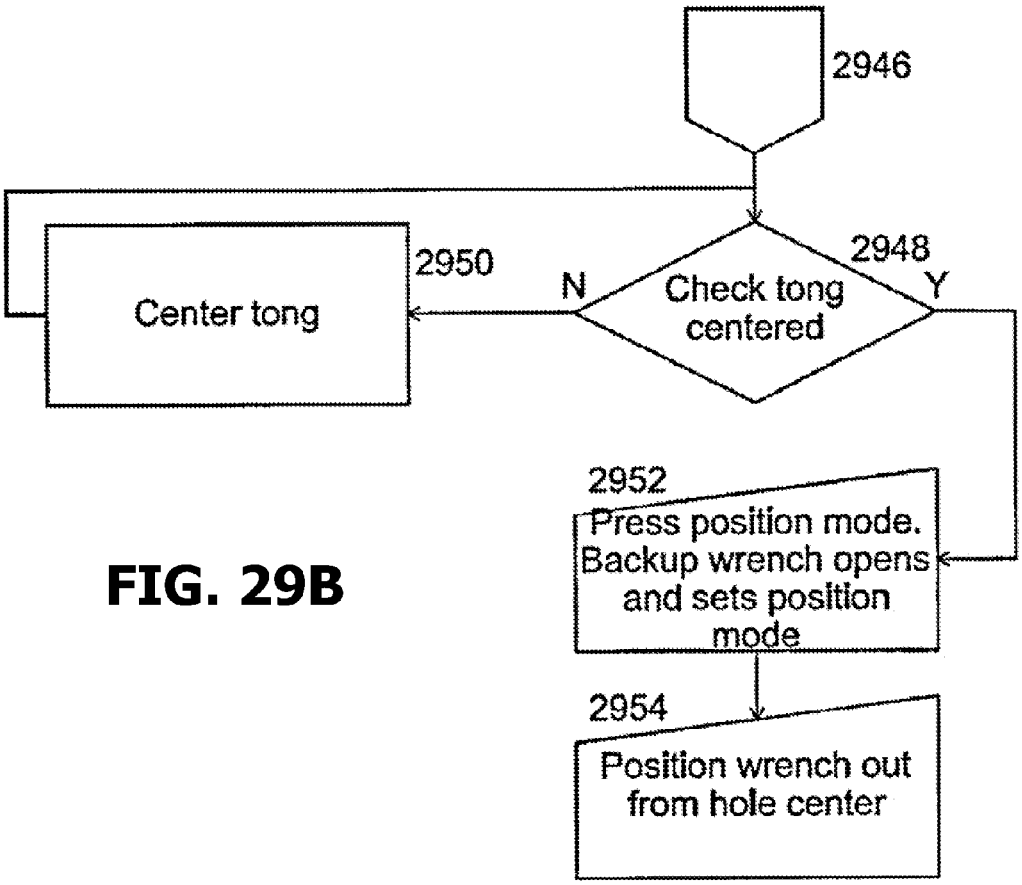
Figure 33:
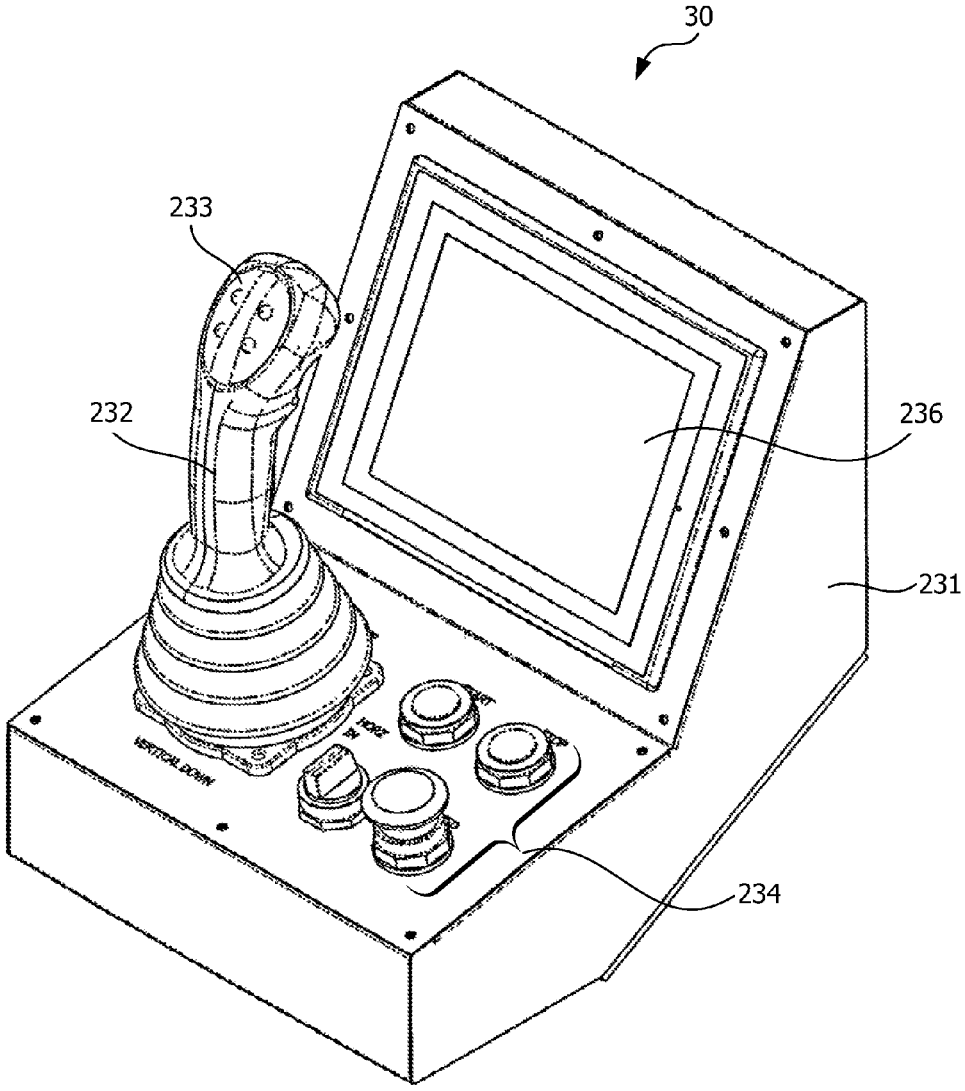
FIG. 33 is a perspective view depicting an operator console for use with the power tong assembly of FIG. 1 or FIG. 26.

In some embodiments, control system 238 can comprise console assembly 30 operatively coupled to PLC 254 via control cable 256. In some embodiments, control system 238 can operate power tong assembly apparatus 10 in a number of modes. Referring to FIGS. 29A and 29B, a flowchart is set out for manually operating power tong apparatus 10 to perform a "make-up mode" operation, as can be carried out by control system 238. In some embodiments, manual make-up mode process 2900 can comprise of the following steps. At step 2902, an operator can select what size and type of pipe to be made-up from a menu displayed on console 30. At step 2904, a query can be made whether power tong apparatus 10 is centered. If not, then power tong apparatus 10 can be centered at step 2906, and the query at step 2904 repeated. If it is, then a query can be made at step 2908 whether centering mechanism or switch 200 is set correctly for the operation. If not, then centering switch 200 can be correctly set at steps 2910 and 2912, and the query at step 2908 repeated. If yes, then confirmation of centering switch being correctly set can be made at step 2914. At step 2916, the operator can move power tong apparatus 10 into position and vertical align it with the pipe joint. At step 2918, the operative can press Torque Mode on console 30 wherein back-up tong 14 can close and grip the drill string. At step 2920, a query can be made whether centering switch 200 is set correctly. If not, switch 200 can be set correctly for make-up mode at steps 2922 and 2924, and the query at step 2920 repeated. If yes, the setting of switch 200 can be confirmed at step 2926, and the operator can operate joystick 232 disposed on console 30 (as shown in FIG. 33) to start the make-up of the joint connection at step 2928. At step 2930, jaw assembly 150 of power tong 12 can be rotated clockwise to grip and rotate the section of pipe to be connected to the drill string. At step 2932, a query can be made if the rotation speed of jaw assembly 150 is below a desired speed or setpoint for the type and size of pipe being joined. If not, the speed can be lowered at step 2934, and the query at step 2932 repeated. If yes, the process at step 2930 can be continued. At step 2936, a query can be made to determine if the torque applied to the pipe is within the setpoints set for the type and size of pipe being joined. If not, a further query at step 2938 can be made if the number of turns required for joining the pipe is within the setpoints set for the type and size of pipe being joined. If not, then the process can at step 2930 can be continued. If yes, then a message stating that the make-up operation failed can be displayed on console 30 at step 2940, and the information logged in a datafile. If the answer to the query at step 2936 is yes, then a further query at step 2942 can be made if the number of turns for joining the pipe is within the setpoints set for the pipe. If not, then a message stating that the make-up operation failed can be displayed on console 30 at step 2940, and the information logged in a datafile. If yes, then a message stating that the make-up operation is complete can be displayed on console 30 at step 2944. Continuing through connector 2946 from FIG. 29A to FIG. 29B, process 2900 can continue at step 2948, where a query can be made whether power tong apparatus 10 is centered. If not, power tong apparatus 10 can be centered at step 2950, and the query at step 2948 repeated. If yes, the operator can press Position Mode on console 30 at step 2952, wherein back-up tong 14 can release the drill string, and then move power tong apparatus 10 away from the hole center and completed pipe joint at step 2954.

Figure 30A:
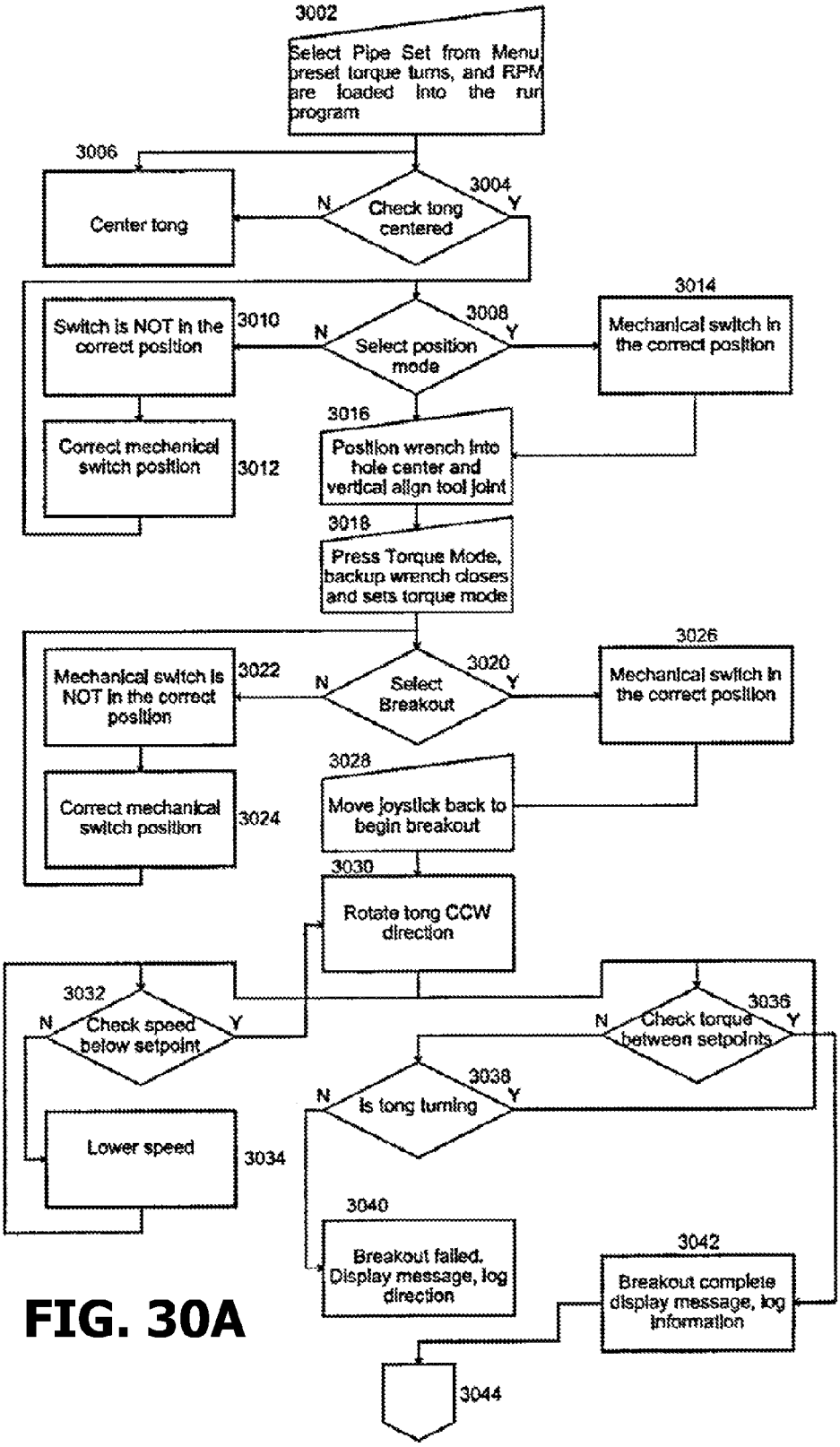
FIGS. 30A and 30B comprise a flowchart depicting a Manual Operation Break Mode of the control system of FIG. 28.
Figure 30B:
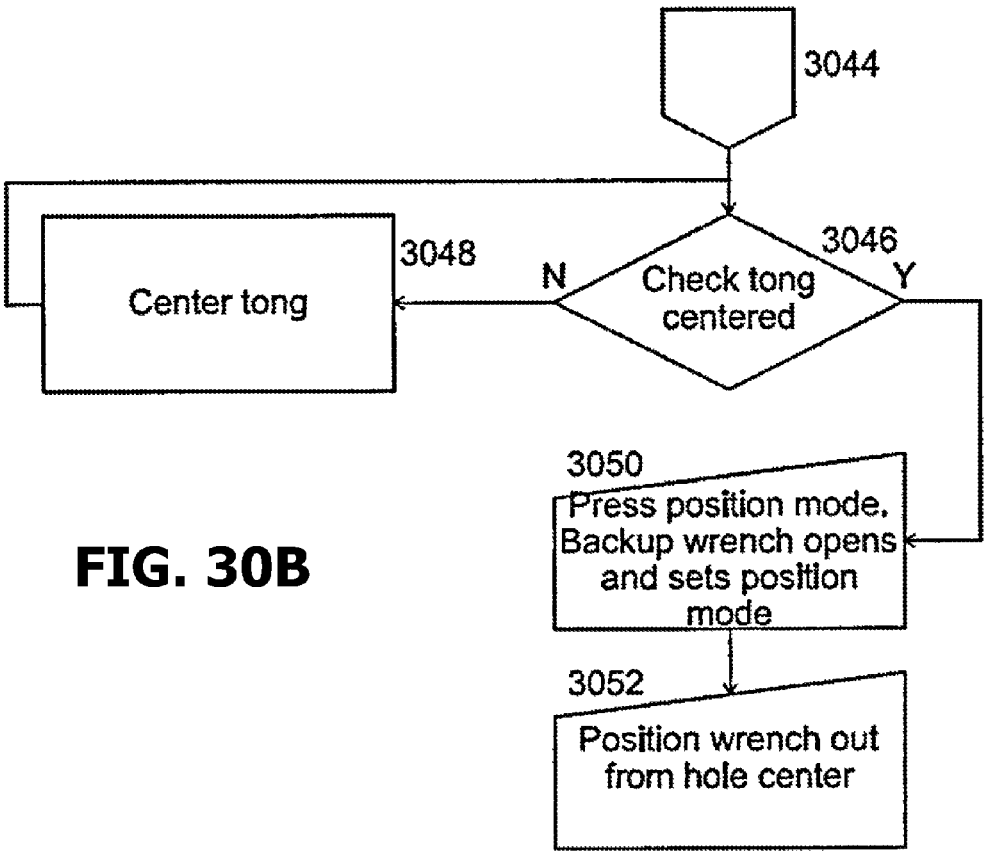

Referring to FIGS. 30A and 30B, a flowchart is set out for manually operating power tong apparatus 10 to perform a "break-out mode" operation, as can be carried out by control system 238. In some embodiments, manual break-out mode process 3000 can comprise of the following steps. At step 3002, an operator can select what size and type of pipe to be broken out from a menu displayed on console 30. At step 3004, a query can be made whether power tong apparatus 10 is centered. If not, then power tong apparatus 10 can be centered at step 3006, and the query at step 3004 repeated. If it is, then a query can be made at step 3008 whether centering switch 200 is set correctly for the operation. If not, then centering switch 200 can be correctly set at steps 3010 and 3012, and the query at step 3008 repeated. If yes, then confirmation of centering switch being correctly set can be made at step 3014. At step 3016, the operator can move power tong apparatus 10 into position and vertical align it with the pipe joint. At step 3018, the operative can press Torque Mode on console 30 wherein back-up tong 14 can close and grip the drill string. At step 3020, a query can be made whether centering switch 200 is set correctly. If not, switch 200 can be set correctly for break-out mode at steps 3022 and 3024, and the query at step 3020 repeated. If yes, the setting of switch 200 can be confirmed at step 3026, and the operator can operate joystick 232 disposed on console 30 (as shown in FIG. 33) to start the break-out of the joint connection at step 3028. At step 3030, jaw assembly 150 of power tong 12 can be rotated counter-clockwise to grip and rotate the section of pipe to be disconnected from the drill string. At step 3032, a query can be made if the rotation speed of jaw assembly 150 is below a desired speed or set point for the type and size of pipe being broken out. If not, the speed can be lowered at step 3034, and the query at step 3032 repeated. If yes, the process at step 3030 can be continued. At step 3036, a query can be made to determine if the number of turns required for breaking the pipe joint is within the set points set for the type and size of pipe being broken out. If not, then a query can be made at step 3038 if jaw assembly 150 is turning. If not, then a message stating that the break-out operation failed can be displayed on console 30 at step 3040, and the information logged in a data file. If the answer to the query at step 3038 is yes, then the query at step 3036 can be repeated. If the answer to the query at step 3036 is yes, then a message stating that the break-out operation is complete can be displayed on console 30 at step 3042. Continuing through connector 3044 from FIG. 30A to FIG. 30B, process 3000 can continue at step 3046, where a query can be made whether power tong apparatus 10 is centered. If not, power tong apparatus 10 can be centered at step 3048, and the query at step 3046 repeated. If yes, the operator can press Position Mode on console 30 at step 3050, wherein back-up tong 14 can release the drill string, and them move power tong apparatus 10 from the hole center and broken out pipe joint at step 3052.

Figure 31A:
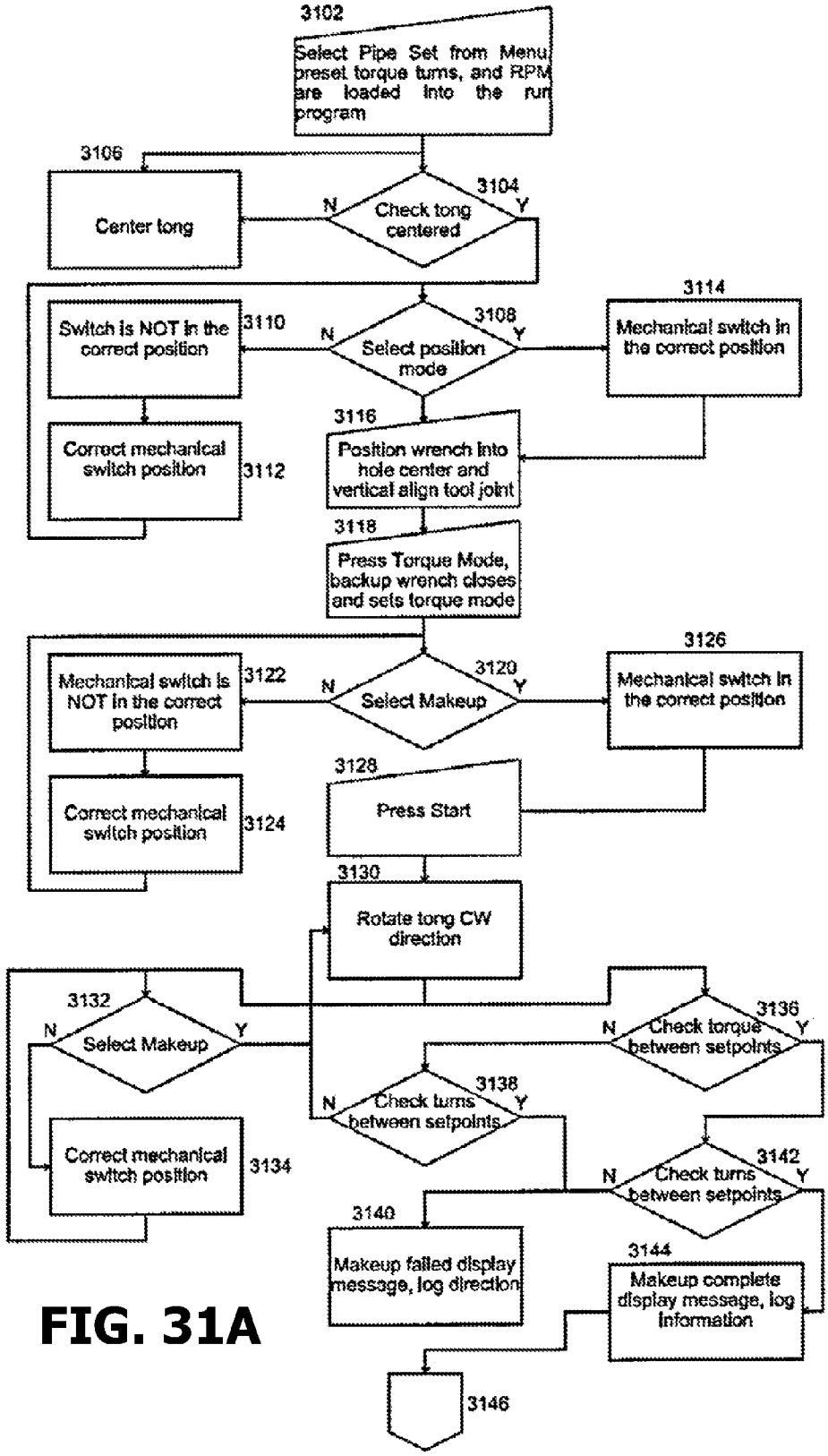
FIGS. 31A and 31B comprise a flowchart depicting an Auto Operation Make Mode of the control system of FIG. 28.
Figure 31B:
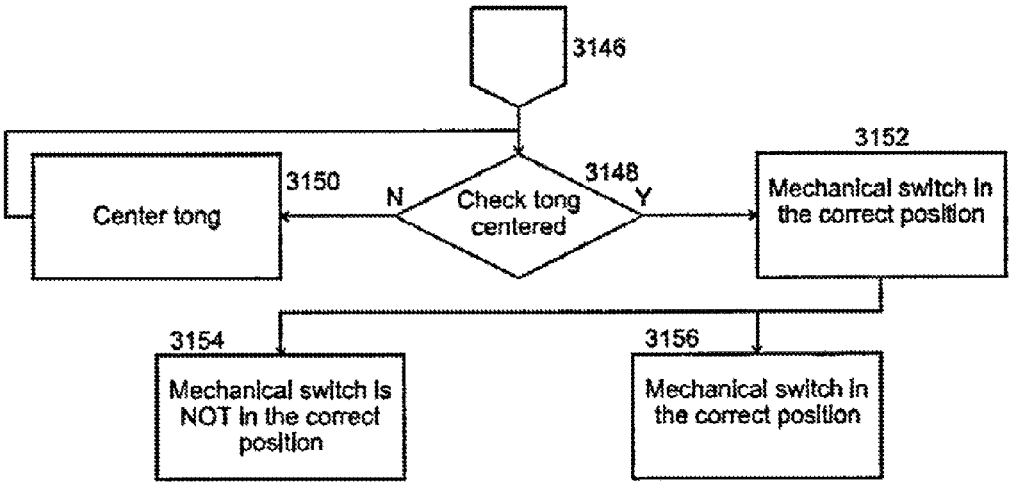

Referring to FIGS. 31A and 31B, a flowchart is set out for automatically operating power tong apparatus 10 to perform a "make-up mode" operation, as can be carried out by control system 238. In some embodiments, manual make-up mode process 3100 can comprise of the following steps. At step 3102, an operator can select what size and type of pipe to be made-up from a menu displayed on console 30. At step 3104, a query can be made whether power tong apparatus 10 is centered. If not, then power tong apparatus 10 can be centered at step 3106, and the query at step 3104 repeated. If it is, then a query can be made at step 3108 whether centering switch 200 is set correctly for the operation. If not, then centering switch 200 can be correctly set at steps 3110 and 3112, and the query at step 3108 repeated. If yes, then confirmation of centering switch being correctly set can be made at step 3114. At step 3116, the operator can move power tong apparatus 10 into position and vertical align it with the pipe joint. At step 3118, the operative can press Torque Mode on console 30 wherein back-up tong 14 can close and grip the drill string. At step 3120, a query can be made whether centering switch 200 is set correctly. If not, switch 200 can be set correctly for make-up mode at steps 3122 and 3124, and the query at step 3120 repeated. If yes, the setting of switch 200 can be confirmed at step 3126, and the operator can press Start on console 30 to start the make-up of the joint connection at step 3128. At step 3130, jaw assembly 150 of power tong 12 can be rotated clockwise to grip and rotate the section of pipe to be connected to the drill string. At step 3132, a query can be made if the rotation speed of jaw assembly 150 is below a desired speed or setpoint for the type and size of pipe being joined. If not, the speed can be lowered at step 3134, and the query at step 3132 repeated. If yes, the process at step 3130 can be continued. At step 3136, a query can be made to determine if the torque applied to the pipe is within the setpoints set for the type and size of pipe being joined. If not, a further query at step 3138 can be made if the number of turns required for joining the pipe is within the setpoints set for the type and size of pipe being joined. If not, then the process can at step 3130 can be continued. If yes, then a message stating that the make-up operation failed can be displayed on console 30 at step 3140, and the information logged in a datafile. If the answer to the query at step 3136 is yes, then a further query at step 3142 can be made if the number of turns for joining the pipe is within the setpoints set for the pipe. If not, then a message stating that the make-up operation failed can be displayed on console 30 at step 3140, and the information logged in a datafile. If yes, then a message stating that the make-up operation is complete can be displayed on console 30 at step 3144. Continuing through connector 3146 from FIG. 31A to FIG. 31B, process 3100 can continue at step 3148, where a query can be made whether power tong apparatus 10 is centered. If not, power tong apparatus 10 can be centered at step 3150, and the query at step 3148 repeated. If yes, the operator can press Position Mode on console 30 at step 3152, wherein back-up tong 14 can release the drill string, and then move power tong apparatus 10 from the hole center and completed pipe joint to one of two operator-defined positions at either of steps 3154 and 3156.

Figure 32A:
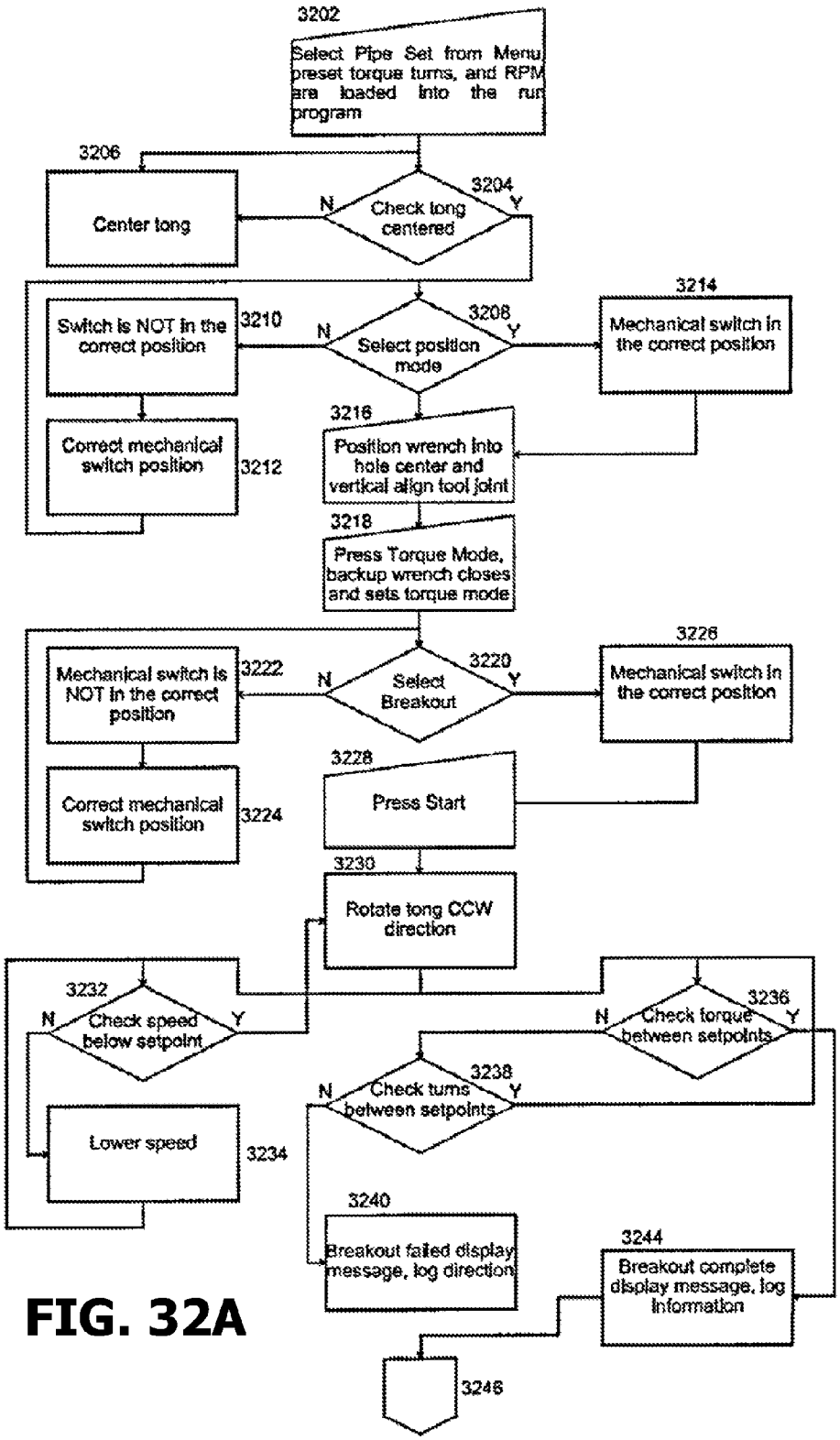
FIGS. 32A and 32B comprise a flowchart depicting an Auto Operation Break Mode of the control system of FIG. 28.
Figure 32B:
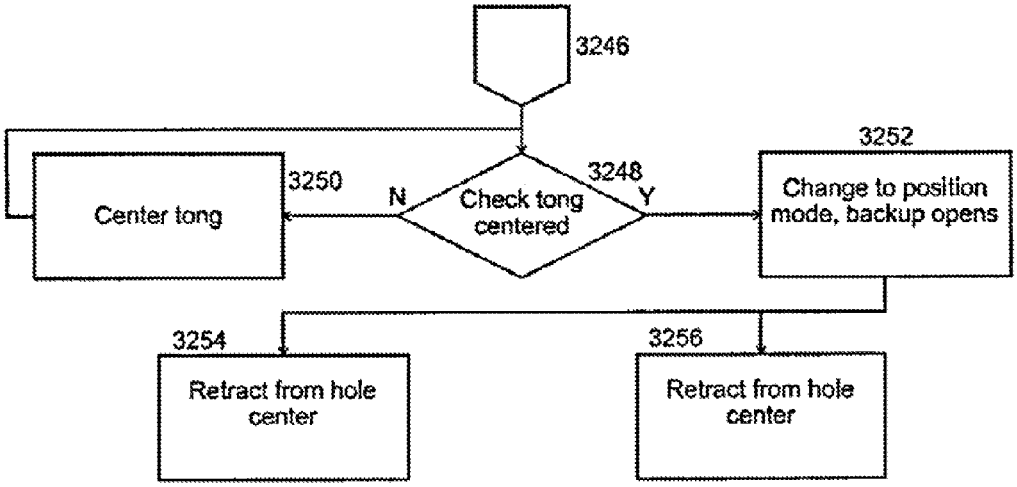

Referring to FIGS. 32A and 32B, a flowchart is set out for automatically operating power tong apparatus 10 to perform a "break-out mode" operation, as can be carried out by control system 238. In some embodiments, manual break-out mode process 3200 can comprise of the following steps. At step 3202, an operator can select what size and type of pipe to be broken out from a menu displayed on console 30. At step 3204, a query can be made whether power tong apparatus 10 is centered. If not, then power tong apparatus 10 can be centered at step 3206, and the query at step 3204 repeated. If it is, then a query can be made at step 3208 whether centering switch 200 is set correctly for the operation. If not, then centering switch 200 can be correctly set at steps 3210 and 3212, and the query at step 3208 repeated. If yes, then confirmation of centering switch being correctly set can be made at step 3214. At step 3216, the operator can move power tong apparatus 10 into position and vertical align it with the pipe joint. At step 3218, the operative can press Torque Mode on console 30 wherein back-up tong 14 can close and grip the drill string. At step 3220, a query can be made whether centering switch 200 is set correctly. If not, switch 200 can be set correctly for break-out mode at steps 3222 and 3224, and the query at step 3220 repeated. If yes, the setting of switch 200 can be confirmed at step 3226, and the operator can press Start on console 30 to start the break-out of the joint connection at step 3228. At step 3230, jaw assembly 150 of power tong 12 can be rotated counter-clockwise to grip and rotate the section of pipe to be disconnected from the drill string. At step 3232, a query can be made if the rotation speed of jaw assembly 150 is below a desired speed or setpoint for the type and size of pipe being broken out. If not, the speed can be lowered at step 3234, and the query at step 3232 repeated. If yes, the process at step 3230 can be continued. At step 3236, a query can be made to determine if the number of turns required for breaking the pipe joint is within the setpoints set for the type and size of pipe being broken out. If not, then a query can be made at step 3238 if jaw assembly 150 is turning. If not, then a message stating that the break-out operation failed can be displayed on console 30 at step 3240, and the information logged in a datafile. If the answer to the query at step 3238 is yes, then the query at step 3236 can be repeated. If the answer to the query at step 3236 is yes, then a message stating that the break-out operation is complete can be displayed on console 30 at step 3242. Continuing through connector 3244 from FIG. 32A to FIG. 32B, process 3200 can continue at step 3246, where a query can be made whether power tong apparatus 10 is centered. If not, power tong apparatus 10 can be centered at step 3248, and the query at step 3246 repeated. If yes, the operator can press Position Mode on console 30 at step 3250, wherein back-up tong 14 can release the drill string, and then power tong apparatus 10 from the hole center and broken out pipe joint to one of two operator-defined positions at either of steps 3252 and 3254.

Referring to FIG. 33, an embodiment of console 30 for use with power tong apparatus 10 is shown. In some embodiments, console 30 can comprise housing 231 that can further comprise joystick 232, push-button controls 234, touchscreen 236, and push-button controls 233 disposed on joystick 232 for controlling power tong assembly 10. In some embodiments, an operator can use the automatic controls on console 30 or use the manual hydraulic levers 22 on the side of power tong assembly 10 itself, as shown in FIG. 1 or 26. In some embodiments, Auto Control can be used to control power tong assembly 10. In some embodiments, controls 234 can comprise of 3 buttons: "Start", "Reset" and an "ESD" (Emergency Shut Down) button. Console 30 can further comprise a 2 way switch (VALVE CNTR), a 4-axis joystick 232 (Up, Down, In, Out) and touch screen 236. Joystick 232 can further comprise 4 thumb buttons 233: "TORQ", "POSI", "MAKE BREAK" and "CNTR". Joystick 232 can further comprise a dead man trigger switch (not shown).

In some embodiments, joystick 232 can be used to control movement of power tong apparatus 10 (position mode) and to makeup/breakout joints (torque mode). In some embodiments, the movement controls of joystick 232 can be configured to work only if the dead man switch is squeezed and held. To adjust the position of power tong apparatus 10 in some embodiments, console 30 can be set in "POSITION MODE" by pressing the POSI button. The "POSITION MODE" indicator light on touchscreen 236 will be highlighted green if position mode is selected. Moving joystick 232 to the left or right can rotate power tong apparatus 10 in and out of hole center, whereas moving joystick 232 up and down can raise or lower power tong apparatus 10 to the desired height. To makeup or breakout a joint, "TORQUE MODE" can be selected by pressing the TORQ button to switch to torque mode upon which, the "TORQUE MODE" indicator light will be highlighted green on touchscreen 236. In some embodiments, when "TORQUE MODE" is selected, back-up tong 14 can automatically close upon a pipe, and when "POSITION MODE" is selected, back-up tong 14 can automatically open. In some embodiments, pressing the MAKE BREAK button can switch between make up and break out modes upon which, the appropriate indicator on touchscreen 236 can turn green to show the current mode. In some embodiments, pressing the CNTR button can automatically center the jaw assembly 150. Jaw assembly 150 will rotate to center in the clockwise direction if in break-out mode, and in the counter-clockwise direction if in make-up mode. In some embodiments, pressing the Start button can begin the make-up or break-out auto sequence. Pressing the Reset button can stop the auto sequence, and can be used to clear error messages. Pressing the ESD button can stop the operation of power tong apparatus 10 immediately and disable all controls on console 30. In some embodiments, the VALVE CNTRL/PLC CNTRL selector switch can be used to set the method of control of power tong apparatus 10. If the switch is set to PLC CNTRL, console 30 can be used. If the switch is set to VALVE CNTRL, then hydraulic valve bank 22 can to be used, and controls on console 30 can be disabled.

Figure 34:
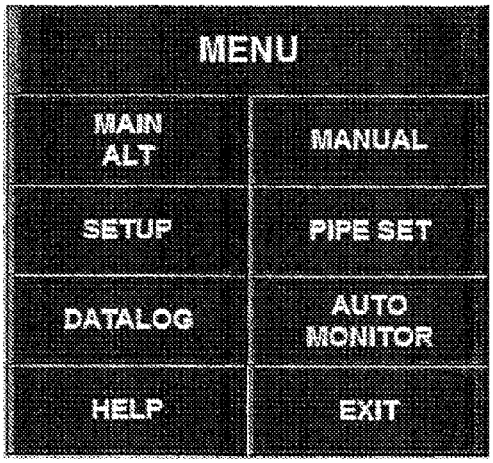
FIG. 34 is a depiction of a Menu Screen displayed on the operator console of FIG. 33.

Referring to FIG. 34, touchscreen 236 can be used to navigate through a number of different screens and functions displayed thereon. As shown in FIG. 34, in some embodiments, the MENU screen can display seven modes of functionality: MAIN, MANUAL, SETUP, PIPE SET, DATALOG, AUTO MONITOR and HELP, in addition to EXIT mode.

Figure 35:
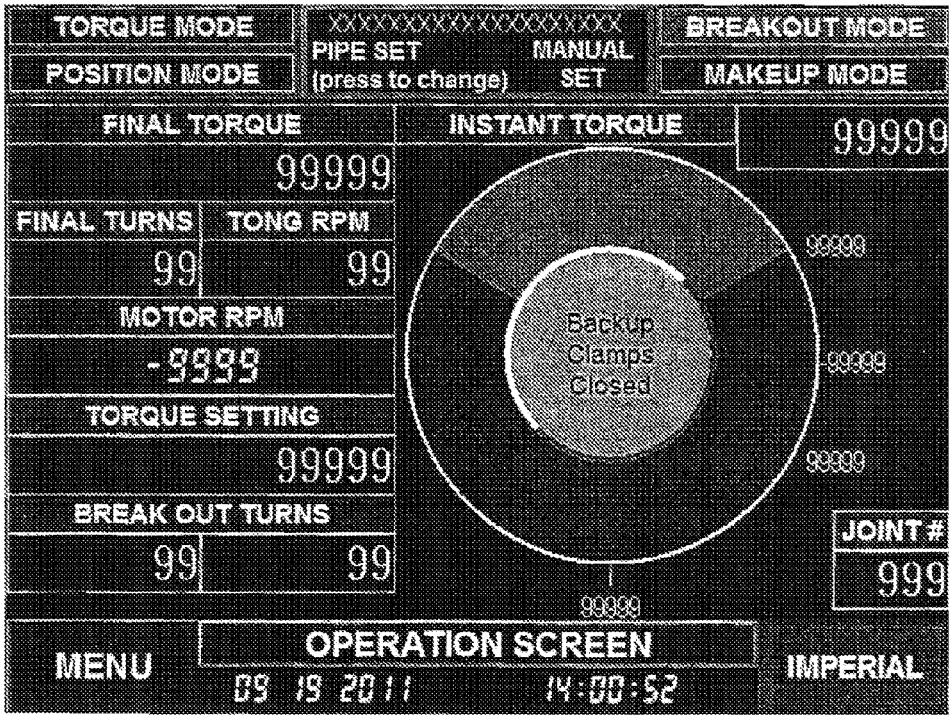
FIG. 35 is a depiction of a Main Screen displayed on the operator console of FIG. 33.

Referring to FIG. 35, an embodiment of the MAIN screen is shown. In some embodiments, the MAIN screen can list information such as: torque setpoint, last torque achieved, number of turns of the tong during the last make/break and instantaneous torque reading. This screen can be the most used screen as an operator will want to see the torque readings when making up a joint. An operator can switch between metric and imperial units by pressing the button on the lower right corner of the screen. When this button reads "IMPERIAL", the units displayed can be in imperial. If the button reads "METRIC", the units being displayed can be metric. "FINAL TORQUE" can be the torque that has been reached while making up a joint, "INSTANT TORQUE" can be the torque being applied to the joint at that exact moment. "FINAL TURNS" can be how may turns of the tong it took to make up the joint. "TONG RPM" can be the RPM of the tong at a given moment. "MOTOR RPM" can be the RPM of the motor at a given moment. "TORQUE SETTING" can be the set point for makeup that has been input into the current pipe profile. The "BREAK OUT TURNS" box will only be displayed if console 30 is in break-out mode. If console 30 is in make-up mode, then the label can be replaced by 2 labels: "TURN MIN" and "TURN MAX". These settings can be displayed from the pipe profile that the operator has chosen. To change a pipe setting, the "PIPE SET" box at the top middle of touchscreen 236 can be pressed. This can bring up a popup window where the operator user can select a specific predetermined pipe profile. If the operator wants to quickly change the torque setting to a custom torque, he can simply choose "0" on the pipe setting popup. This will allow the operator to input different settings directly into the boxes on the main screen.

Figure 36:
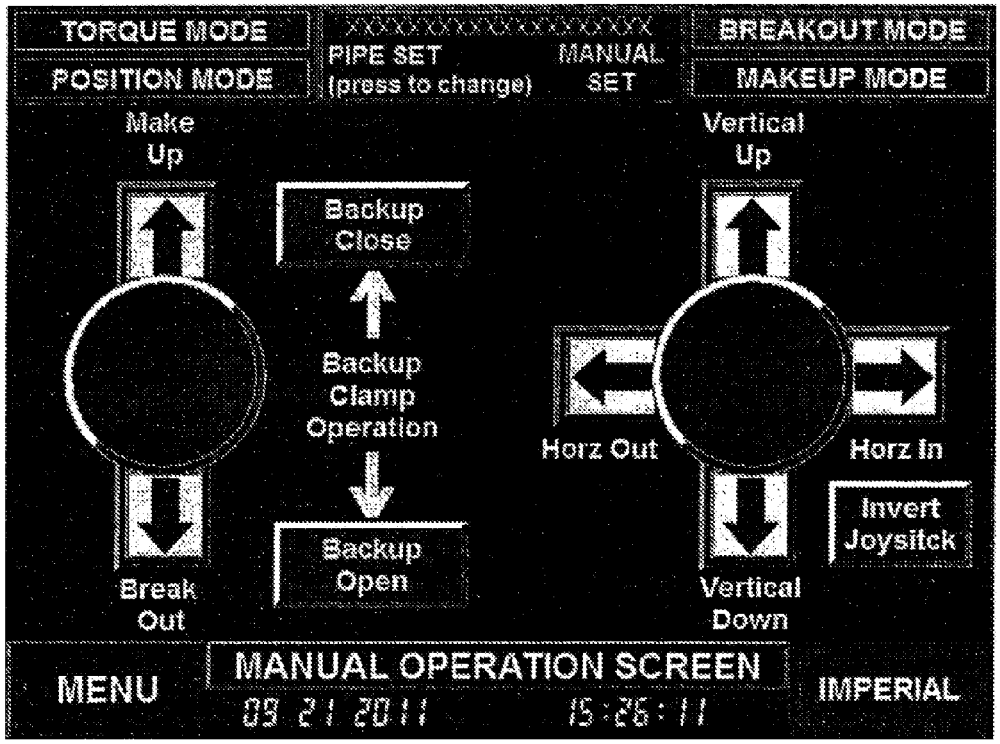
FIG. 36 is a depiction of a Manual Screen displayed on the operator console of FIG. 33.

Referring to FIG. 36, an embodiment of the MANUAL screen is shown. In some embodiments, the MANUAL screen can be used to control power tong apparatus 10 via touchscreen 236. The MANUAL screen can comprise of many buttons for the various functions of power tong apparatus 10. In some embodiments, the Invert Joystick button can invert the vertical controls of the joystick. The other buttons are self evident to those skilled in the art. This MANUAL screen control can be used as a back-up control option. The joystick or the auto control mode of operation can be used as the standard method of operating power tong apparatus 10.

Figure 37:
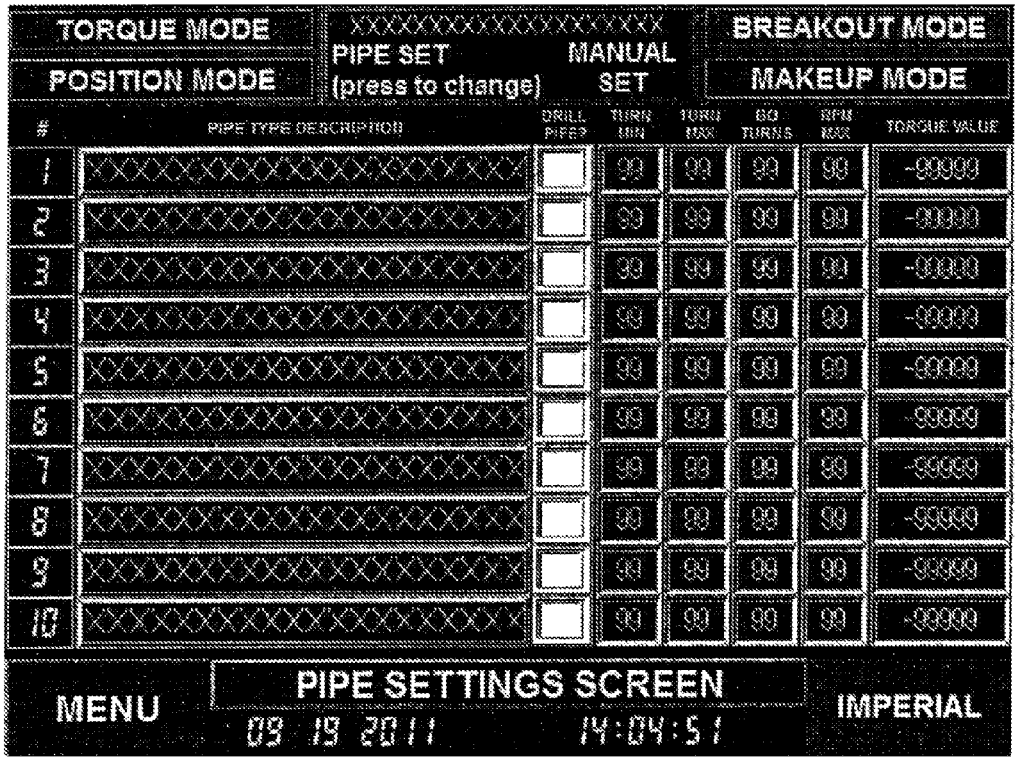
FIG. 37 is a depiction of a Pipe Table screen displayed on the operator console of FIG. 33.

Referring to FIG. 37, an embodiment of the PIPE TABLE screen is shown. In some embodiments, the PIPE TABLE screen can be used by an operator to set up all the different types of pipe that the rig will be running. In some embodiments, the operator can input up to 10 different pipe profiles, where each profile requires an input for the "PIPE TYPE DESCRIPTION", "TURN MIN", "TURN MAX", "BO TURNS", "RPM MAX" and "TORQUE VALUE".

PIPE TYPE DESCRIPTION—This can be the description of the pipe given by the operator. TURN MAX and TURN MIN—These can represent the min and max number of turns jaw assembly 150 should rotate for the joint to be made up. If the joint is made up before the min number of turns, then a message can be displayed stating that the pipe might be incorrectly torqued and it should be checked. This might happen if the joint was cross threaded. The turn max setting is the maximum turns allowed. Jaw assembly 150 can stop rotating if the max turn limit has been reached. This is to prevent over torque due to a failure in the torque sensor. It can state the size and type of pipe.

BO TURNS—This box can be used to set the total number turns that the auto breakout will complete per sequence.

RPM MAX—This can set the max speed of the tong for makeup or breakout.

TORQUE VALUE—The torque set point for every joint made up under the given profile.

DRILL PIPE—This check box can be checked off if the type of pipe is drill pipe. This can be used when making up so that the tong will shoulder the connection softly to avoid over torquing the joint.

Figure 38:
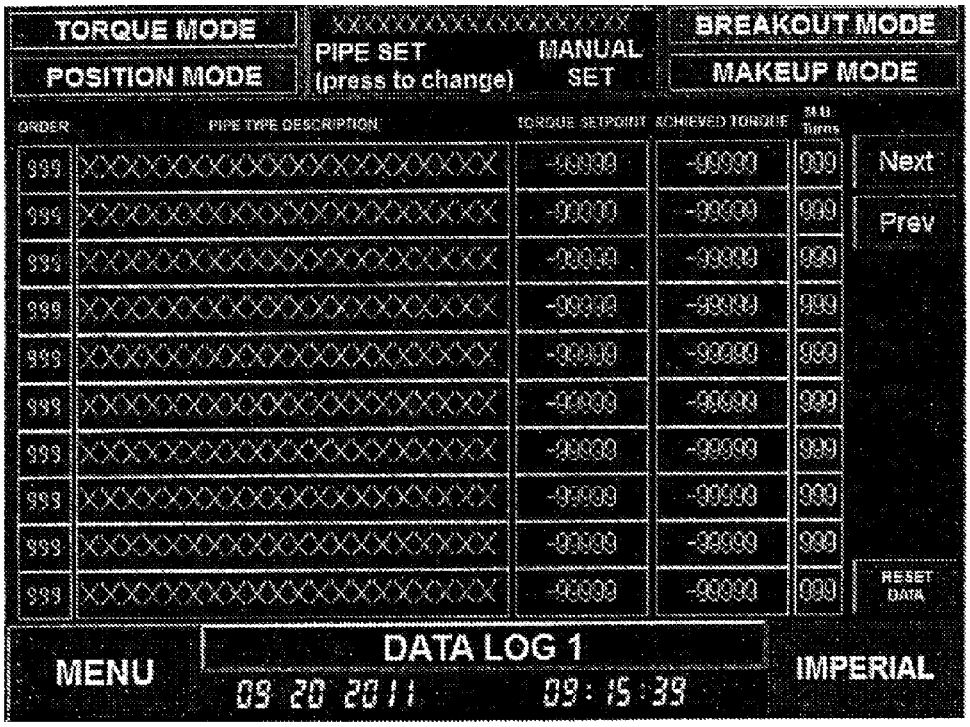
FIG. 38 is a depiction of a Datalog screen displayed on the operator console of FIG. 33.

Referring to FIG. 38, an embodiment of the DATALOG screen is shown. In some embodiments, the DATALOG screen can list information for every joint made up. In some embodiments, up to 500 logs can be recorded. Each record can comprise five components: "ORDER", "PIPE DESCRIPTION", "TORQUE SETPOINT", "ACHIEVED TORQUE" and "M.U. TURNS" (make-up turns).

ORDER—This can describe the order of the joints made up, 1 through 500, "1" being the first joint made up for the well.

PIPE DESCRIPTION—This can be the description of the pipe used including pipe size and type.

TORQUE SETPOINT—This can be the desired torque set point for the joint.

ACHIEVED TORQUE—This can be the torque that was actually achieved during make up.

M.U. TURNS—This can show how many turns of the tong it took to completely torque the joint.

In some embodiments, pressing the next or prev buttons can skip to the next or previous page of logs. The reset data button can erase all the data in the datalog. In some embodiments, the reset button is only displayed on the first datalog screen.

Figure 39:
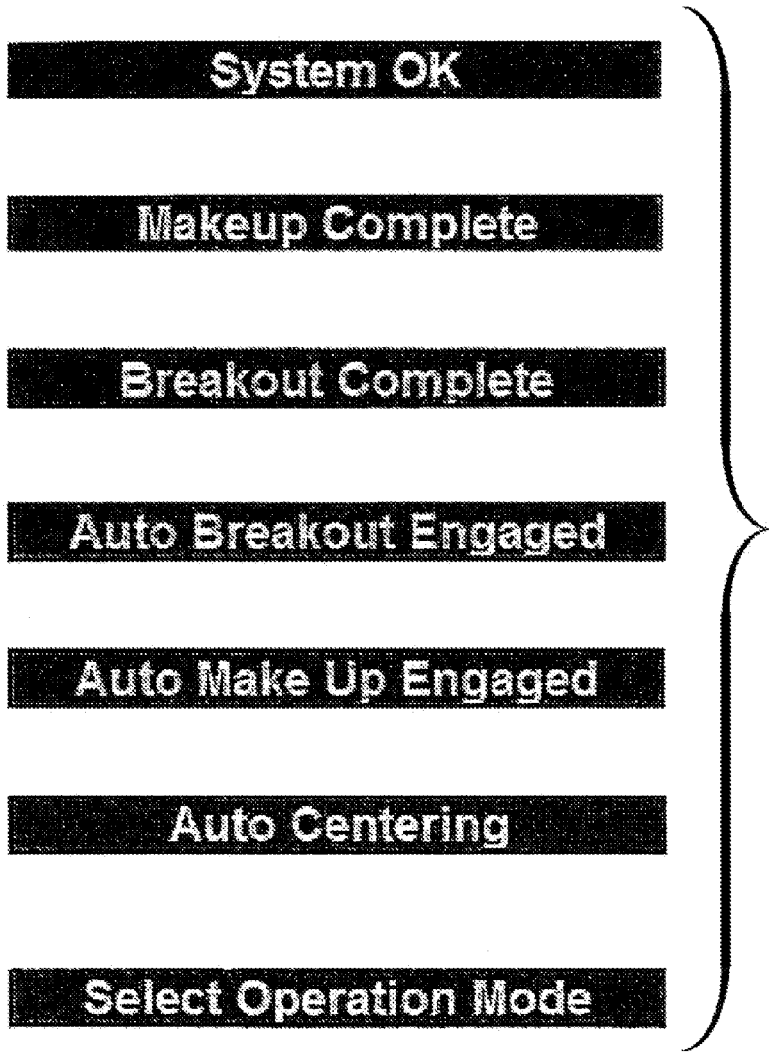
FIG. 39 is a depiction of a first set of Error Messages screen displayed on the operator console of FIG. 33.
Figure 40:
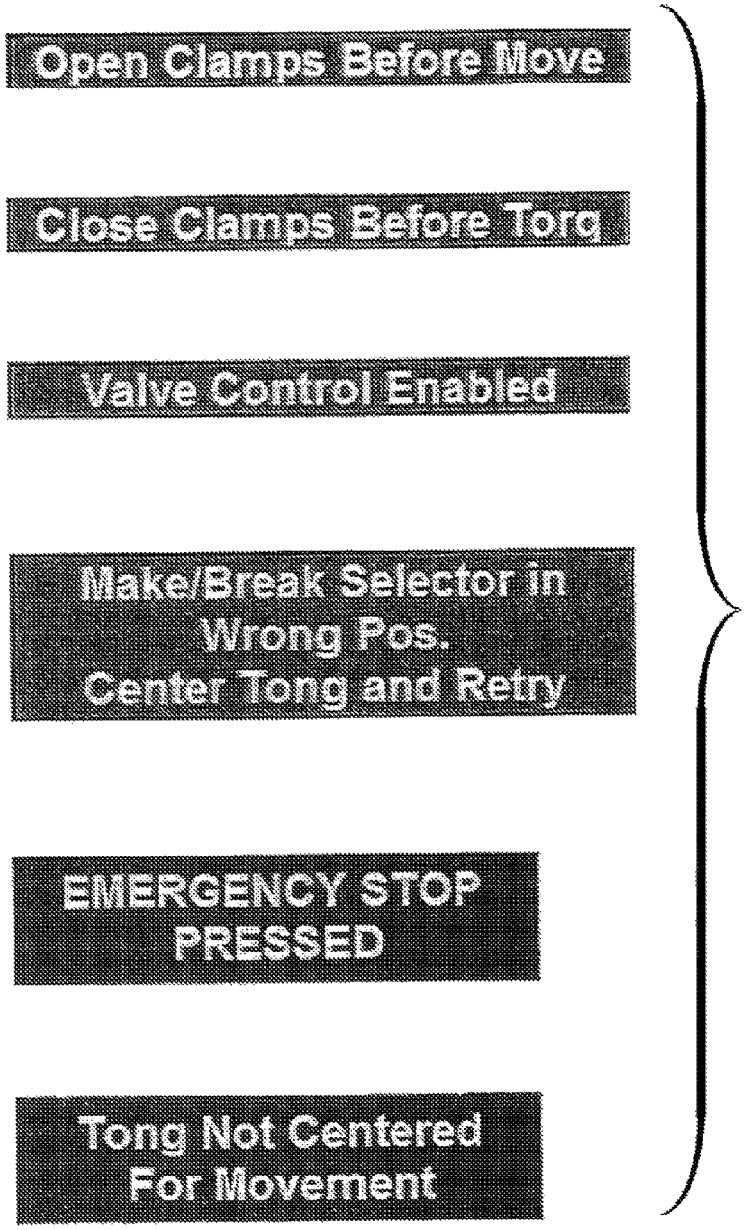
FIG. 40 is a depiction of a second set of Error Messages screen displayed on the operator console of FIG. 33.
Figure 41:
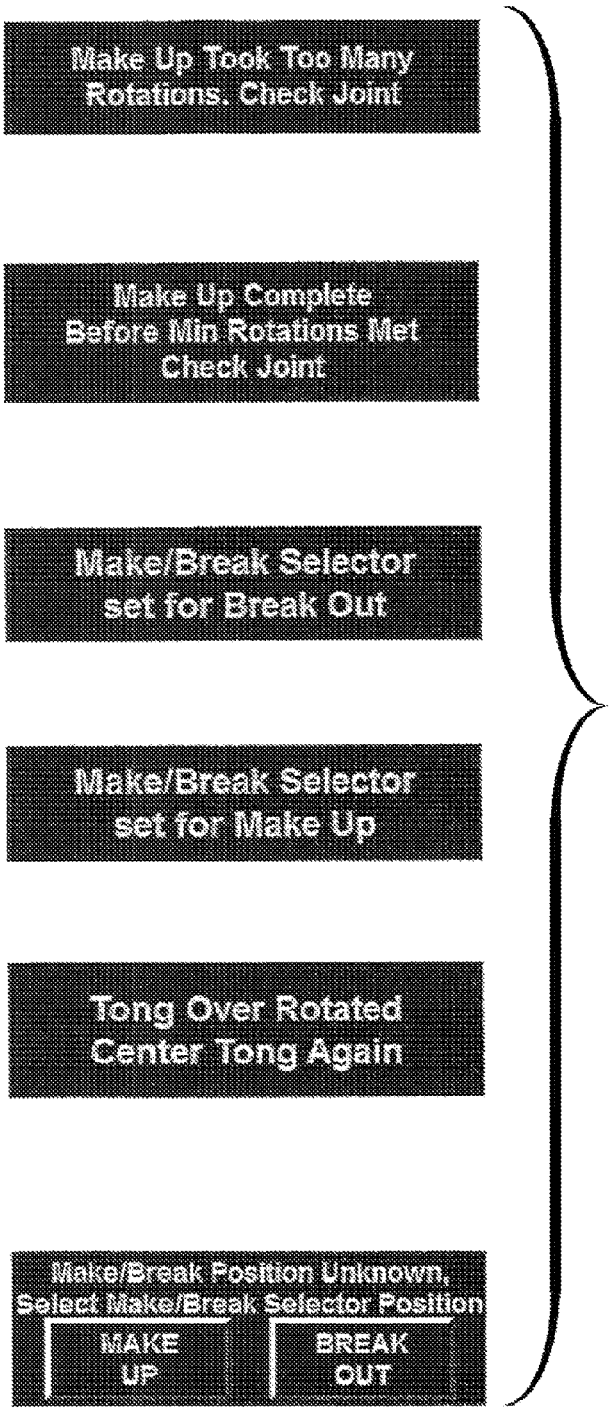
FIG. 41 is a depiction of a third set of Error Messages screen displayed on the operator console of FIG. 33.

Referring to FIGS. 39 to 41, embodiments of ERROR MESSAGES screens are shown. In some embodiments, a number of different error messages can be displayed during use of console 30 in the operation of power tong apparatus 10. FIGS. 39 to 41 illustrate the different error messages that can be displayed, and describe the meaning or nature of these error messages.

In some embodiments, power tong apparatus 10 can be operated by the following steps. While in position mode, joystick 232 can be used to move power tong apparatus 10 to hole-center, and to center the apparatus on the joint with power tong 12 over the pipe coupling and back-up tong 14 under the pipe coupling. Once the apparatus has been positioned correctly on the joint, the "Torque Mode" button can be pressed on joystick 232. Back-up tong 14 will close automatically, and a joint can now be made up or broken out. The MAKEUP BREAKOUT button can be used to switch between these two modes of operation. The make/break selector (centering switch 200) must match the mode of operation to be used. For example, in Make Up mode on touchscreen 236, centering switch 200 must be up so jaw assembly 150 will close on the pipe while rotating clockwise to make up the joint. If the joint is to be broken out, centering switch 200 must be in break-out mode. In some embodiments, centering switch 200 can only be switched between make-up and break-out if jaw assembly 150 has already been centered. If centering switch 200 is operated when jaw assembly 150 is not at center, the apparatus will not operate correctly and there can be risk ins damaging the apparatus and/or the pipe. Once centering switch 200 and the mode button are properly selected, an operator can make up or break out the joint with the operators controls using one of three different methods: Joystick Control, Auto Control and Screen Control.

JOYSTICK CONTROL—The dead-man switch on joystick 232 can be squeezed, and joystick 232 can be pulled back for break out or pushed forward for make-up. Jaw assembly 150 can then start spinning. If making up the joint, once the joint has reached the desired torque the apparatus will stop, and the CNTR button can be pressed to center jaw assembly 150.

SCREEN CONTROL—In some embodiments, the apparatus' functions can be controlled using the MANUAL screen as well. To do this, an operator must make sure the apparatus is in the correct mode, and that centering switch 200 is set correctly. The Torque mode can be used to make-up or break-out a joint. The Break Out or Make Up buttons can be pressed and held to break or make a joint. If in makeup mode, the apparatus will stop and jaw assembly 150 can center automatically once the joint reaches its torque set point.

AUTO CONTROL—In some embodiments, this can be the simplest way to control the apparatus. As in other modes, an operator can make sure the apparatus is centered over the joint, and that the apparatus is in "Torque Mode", and that centering switch 200 is in the correct position. The "Start" button can then be pressed, and the apparatus can either break or make the joint. If in Make-up mode, a torque can be read on the main screen, and when the torque setting has been reached, the apparatus can automatically stop making the joint up and rotate the other direction until jaw assembly 150 is centered. If in break out mode, the apparatus can break the joint and spin out the pipe for a set amount of rotations (this is set in the "Pipe Set" screen and determined by what pipe setting you have selected). Once jaw assembly 150 has rotated the set amount of turns, jaw assembly 150 can stop and rotate the other direction until it has reached the center position.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. A power tong apparatus for making and breaking connection joints between sections of pipe on a drilling rig, the apparatus comprising:

a) a support assembly, further comprising a vertical riser assembly configured for attachment to the drilling rig, and a swing arm assembly operatively attached to the vertical riser assembly wherein the vertical riser and swing arm assemblies are configured such that the swing arm assembly can move up and down relative to the vertical riser assembly, the swing arm assembly further configured to pivot in a substantially horizontal plane relative to the vertical riser assembly;

b) a power tong assembly operatively attached to the swing arm assembly, the power tong assembly further comprising:

i) a back-up tong configured to grasp a first section of pipe;

ii) a power tong configured to grasp and rotate a second section of pipe relative to the first section of pipe to make or break a connection joint between the first and second sections of pipe; and iii) power tong support means for supporting the power tong above the back-up tong; and c) control means for controlling the operation of the support assembly and of the power tong assembly.

2. The apparatus as set forth in claim 1, wherein the vertical riser assembly further comprises:

a) a substantially vertical outer tube member further comprising at least one mounting bracket configured for attaching the outer tube member to the drilling rig;

b) a substantially vertical slot disposed along the outer tube member;

c) an inner tube member having upper and lower ends, the inner tube member slidably disposed in the outer tube member and configured for upward and downward movement within the outer tube member;

d) means for moving the inner tube member upwards and downwards relative to the outer tube member; and e) attachment means for pivotally attaching the swing arm assembly, the attachment means disposed on the inner tube member and further configured to extend through the slot wherein the power tong assembly can be raised or lowered relative to the vertical riser member when the swing arm assembly is pivotally attached to the attachment means and when the inner tube member moves upwards or downwards within the outer tube member.

3. The apparatus as set forth in claim 2, wherein the means for moving the inner tube member further comprises a first telescoping member operatively coupled between the inner tube member and the outer tube member wherein the inner tube member can move upwards or downwards as the first telescoping member extends or retracts.

4. The apparatus as set forth in claim 3, wherein the first telescoping member further comprises a first hydraulic cylinder.

5. The apparatus as set forth in claim 2, wherein the attachment means further comprises an upper pivot bracket disposed near the upper end of the inner tube member and a lower pivot bracket disposed near the lower end of the inner tube member.

6. The apparatus as set forth in claim 5, wherein the lower pivot bracket further comprises an offset arm.

7. The apparatus as set forth in claim 6, further comprising a second telescoping member operatively coupled between the offset arm and the swing arm assembly wherein the swing arm assembly can pivot in the substantially horizontal plane when the second telescoping member extends or retracts.

8. The apparatus as set forth in claim 7, wherein the second telescoping member further comprises a second hydraulic cylinder.

9. The apparatus as set forth in claim 2, wherein the swing arm assembly further comprises:

a) a fixed horizontal member configured to operatively couple with the attachment means;

b) a telescoping horizontal member operatively coupled to the fixed horizontal member, wherein the telescoping horizontal member is configured to extend from and retract towards the fixed horizontal member; and c) a third telescoping member operatively coupled to the fixed and telescoping horizontal members wherein the telescoping horizontal member can extend from and retract towards the fixed horizontal member when the third telescoping member extends and retracts.

10. The apparatus as set forth in claim 9, wherein the third telescoping member further comprises a third hydraulic cylinder.

11. The apparatus as set forth in claim 1, wherein the back-up tong further comprises:

a) a first frame comprising a first opening configured to receive the first section of pipe; and b) a back-up jaw assembly configured for receiving and grasping the first section of pipe.

12. The apparatus as set forth in claim 11, wherein the back-up jaw assembly further comprises:

a) a pair of back-up jaw carriers operatively coupled together via a hinge, the back-up jaw carriers operatively attached to the first frame, the back-up jaw carriers disposed about the first opening, each back-up jaw carrier comprising a first jaw block configured for gripping the first section of pipe;

b) a back-stop jaw block disposed near the hinge; and c) means for closing the pair of back-up jaw carriers wherein the first section of pipe is grasped by the first jaw blocks and the back-stop jaw block.

13. The apparatus as set forth in claim 12, wherein the means for closing the pair of back-up jaws further comprises:

a) a pincer assembly operatively coupled to the first frame and to the pair of back-up jaws; and b) a fourth telescoping member disposed on the pincer assembly wherein the pair of back-up jaws closes or opens when the fourth telescoping member extends or retracts.

14. The apparatus as set forth in claim 13, wherein the fourth telescoping member further comprises a fourth hydraulic cylinder.

15. The apparatus as set forth in claim 11, wherein the back-up assembly further comprises three telescoping back-up jaw blocks disposed about the first opening.

16. The apparatus as set forth in claim 15, wherein each of the telescoping back-up jaw blocks further comprise a hydraulic ram mechanism.

17. The apparatus as set forth in claim 1, wherein the power tong further comprises:

a) a second frame comprising a second opening configured to receive the second section of pipe;

b) a jaw drive assembly rotatably disposed in the second frame, the jaw drive assembly configured for receiving, grasping and rotating the second section of pipe; and c) drive means for rotating the jaw drive assembly.

18. The apparatus as set forth in claim 17, wherein the drive means further comprises:

a) a drive motor;

b) a gear reducer operatively coupled to the drive motor;

c) a drive shaft operatively coupled to the gear reducer;

d) a drive sprocket or pulley disposed on the drive shaft; and e) a drive chain or belt operatively coupling the drive sprocket or pulley to the jaw drive assembly.

19. The apparatus as set forth in claim 18, wherein the drive motor further comprises a hydraulic motor.

20. The apparatus as set forth in claim 18, wherein the jaw drive assembly further comprises:

a) an upper jaw ring configured to receive the second section of pipe;

b) a lower jaw ring configured to receive the second section of pipe, the lower jaw ring operatively coupled to the upper jaw ring in a spaced-apart configuration;

c) a jaw cam rotatably disposed between the upper and lower jaw rings, the jaw cam configured to be rotated by the drive means, the jaw cam comprising a cam opening further comprising a cam profile disposed thereon;

d) a pair of jaws pivotally disposed between the upper and lower jaw rings within the cam opening, the pair of jaws disposed against the cam profile, each jaw further comprising a second jaw block configured for gripping the second section of pipe; and e) a rear jaw block disposed in the cam opening wherein the rear jaw block and the second jaw blocks are in are in a spaced-apart configuration about the cam opening, the rear jaw block disposed against the cam opening whereupon the jaw cam is rotated relative to the upper and lower jaw rings, the cam profile urges the rear jaw block and the pair of jaws inwardly to grasp and rotate the second section of pipe.

21. The apparatus as set forth in claim 20, wherein the jaw cam further comprises means for being driven by the drive means.

22. The apparatus as set forth in claim 21, wherein the means for being driven further comprises teeth disposed on an outer circumferential edge of the jaw cam, the teeth configured for engaging with the drive chain.

23. The apparatus as set forth in claim 21, wherein the means for being driven further comprises a pulley disposed on an outer circumferential edge of the jaw cam, the pulley configured for engaging with the drive belt.

24. The apparatus as set forth in claim 17, wherein the power tong support means further comprises:

a) a plurality of guide rod receivers disposed on a top surface of the back-up tong;

b) a plurality of guide rods extending downwardly from the second frame, wherein the guide rods are slidably disposed in the guide rod receivers; and c) a plurality of support springs, one support spring disposed on each guide rod, the support springs further disposed between the power tong and the back-up tong, and further configured to suspend the power tong above the back-up tong.

25. The apparatus as set forth in claim 1, wherein the control means further comprises:

a) means for supplying a source of motive power for the support assembly and the power tong assembly, wherein the source of motive power is selected from a group consisting of a pneumatic supply system and a hydraulic fluid supply system; and b) means for controlling the source of motive power, the controlling means operatively coupling the source of motive power to the support assembly and the power tong assembly.

26. The apparatus as set forth in claim 25, wherein the controlling means further comprises a plurality of manually operated valves.

27. The apparatus as set forth in claim 26, wherein the controlling means further comprises a plurality of controllable valves.

28. The apparatus as set forth in claim 27, wherein the controlling means further comprises a programmable logic controller configured to operatively control the controllable valves.

29. The apparatus as set forth in claim 28, wherein the controlling means further comprises an operator's console operatively coupled to the programmable logic controller, the console further comprising a joystick mechanism configured for operatively controlling the programmable logic controller.

* * * * *

UNITED STATES PATENT AND TRADEMARK OFFICE

CERTIFICATE OF CORRECTION

PATENT NO. : 8,733,213 B2
APPLICATION NO. : 13/438766
DATED : May 27, 2014
INVENTOR(S) : M. C. Taggart It is certified that error appears in the above-identified patent and that said Letters Patent is hereby corrected as shown below:

In the Claims

| COLUMN | LINE | ERROR |
|---|---|---|
| 21 (Claim 20) | 5 | Delete the second occurrence of "are in" |

Signed and Sealed this
Twenty-first Day of April, 2015

Michelle K. Lee

Michelle K. Lee
*Director of the United States Patent and Trademark Office*